US011037741B2

(12) United States Patent
Umezu et al.

(10) Patent No.: US 11,037,741 B2
(45) Date of Patent: Jun. 15, 2021

(54) SWITCH AND METHOD OF MANUFACTURING SWITCH

(71) Applicant: ALPS ALPINE CO., LTD., Tokyo (JP)

(72) Inventors: Takahiro Umezu, Santa Clara, CA (US); Takaki Tanaka, Miyagi (JP); Keiko Natsuizaka, Miyagi (JP)

(73) Assignee: ALPS ALPINE CO., LTD., Tokyo (JP)

( * ) Notice: Subject to any disclaimer, the term of this patent is extended or adjusted under 35 U.S.C. 154(b) by 0 days.

(21) Appl. No.: 16/778,049

(22) Filed: Jan. 31, 2020

(65) Prior Publication Data

US 2020/0258697 A1 Aug. 13, 2020

(30) Foreign Application Priority Data

Feb. 12, 2019 (JP) ..... JP2019-022996

(51) Int. Cl.

| | |
|---|---|
| ***H01H 13/52*** | (2006.01) |
| ***H01C 13/02*** | (2006.01) |
| ***H01H 11/00*** | (2006.01) |
| ***H01H 11/06*** | (2006.01) |
| ***H01H 13/10*** | (2006.01) |
| ***H01H 13/18*** | (2006.01) |

(52) U.S. Cl.

CPC ..... *H01H 13/52* (2013.01); *H01C 13/02* (2013.01); *H01H 11/0056* (2013.01); *H01H 11/06* (2013.01); *H01H 13/10* (2013.01); *H01H 13/186* (2013.01); *H01H 2011/0087* (2013.01); *H01H 2013/525* (2013.01); *H01H 2229/04* (2013.01); *H01H 2229/048* (2013.01)

(58) Field of Classification Search

CPC .... H01H 13/52; H01H 11/0056; H01H 11/06; H01C 13/02

USPC ..... 200/238, 284

See application file for complete search history.

(56) References Cited

U.S. PATENT DOCUMENTS

| | | | | |
|---|---|---|---|---|
| 5,880,653 A * | 3/1999 | Yamada | ..... | H01H 49/00 335/78 |
| 9,959,987 B2 | 5/2018 | Tanaka | | |
| 2018/0025855 A1 * | 1/2018 | Tanaka | ..... | H01H 13/06 200/238 |

FOREIGN PATENT DOCUMENTS

| | | |
|---|---|---|
| JP | 2018-014276 | 1/2018 |

* cited by examiner

*Primary Examiner* — Edwin A. Leon
*Assistant Examiner* — Iman Malakooti
(74) *Attorney, Agent, or Firm* — IPUSA, PLLC

(57) ABSTRACT

A switch includes a housing, a switching mechanism housed in the housing and configured to switch a state of connection between at least two terminals exposed out of the housing by using a common contact and two switching contacts, and an electronic component that is disposed in the housing and electrically connects the terminals to each other. The switching mechanism includes a first metal plate that is connected to a first contact, which is one of the common contact and the two switching contacts, and includes a first exposed part to which a first electrode of the electronic component is soldered by laser irradiation, and a second metal plate that is connected to a second contact, which is another one of the common contact and the two switching contacts, and includes a second exposed part to which a second electrode of the electronic component is soldered by laser irradiation.

12 Claims, 16 Drawing Sheets

SWITCH AND METHOD OF MANUFACTURING SWITCH

CROSS-REFERENCE TO RELATED APPLICATION

The present application is based upon and claims priority to Japanese Patent Application No. 2019-022996, filed on Feb. 12, 2019, the entire contents of which are incorporated herein by reference.

BACKGROUND OF THE INVENTION

1. Field of the Invention

An aspect of this disclosure relates to a switch.

2. Description of the Related Art

Japanese Laid-Open Patent Publication No. 2018-014276, for example, discloses a switch including a chip resistor attached to a metal plate by reflow soldering.

In a process for manufacturing the switch, a component formed of a synthetic resin material and including a metal plate embedded by insert molding is placed in a reflow furnace. For this reason, the synthetic resin material needs to have a heat resistance property to withstand a reflow temperature. However, the use of such a heat-resistant synthetic resin material increases the cost for manufacturing a switch.

Accordingly, there is a demand for a switch that can be manufactured at a lower cost.

SUMMARY OF THE INVENTION

In an aspect of this disclosure, there is provided a switch including a housing, a switching mechanism that is housed in the housing and configured to switch a state of connection between at least two terminals exposed out of the housing by using a common contact and two switching contacts, and an electronic component that is disposed in the housing and electrically connects the at least two terminals to each other. The switching mechanism includes a first metal plate that is connected to a first contact, which is one of the common contact and the two switching contacts, and includes a first exposed part to which a first electrode of the electronic component is soldered by laser irradiation, and a second metal plate that is connected to a second contact, which is another one of the common contact and the two switching contacts, and includes a second exposed part to which a second electrode of the electronic component is soldered by laser irradiation. The first exposed part includes a first electrode mounting part on which the first electrode is placed, a first soldering part on which solder is placed, and a first peripheral part disposed along an edge of the first soldering part; the second exposed part includes a second electrode mounting part on which the second electrode is placed, a second soldering part on which solder is placed, and a second peripheral part disposed along an edge of the second soldering part; and each of the first peripheral part and the second peripheral part has a U-shape.

DESCRIPTION OF THE PREFERRED EMBODIMENTS

Figure 1:
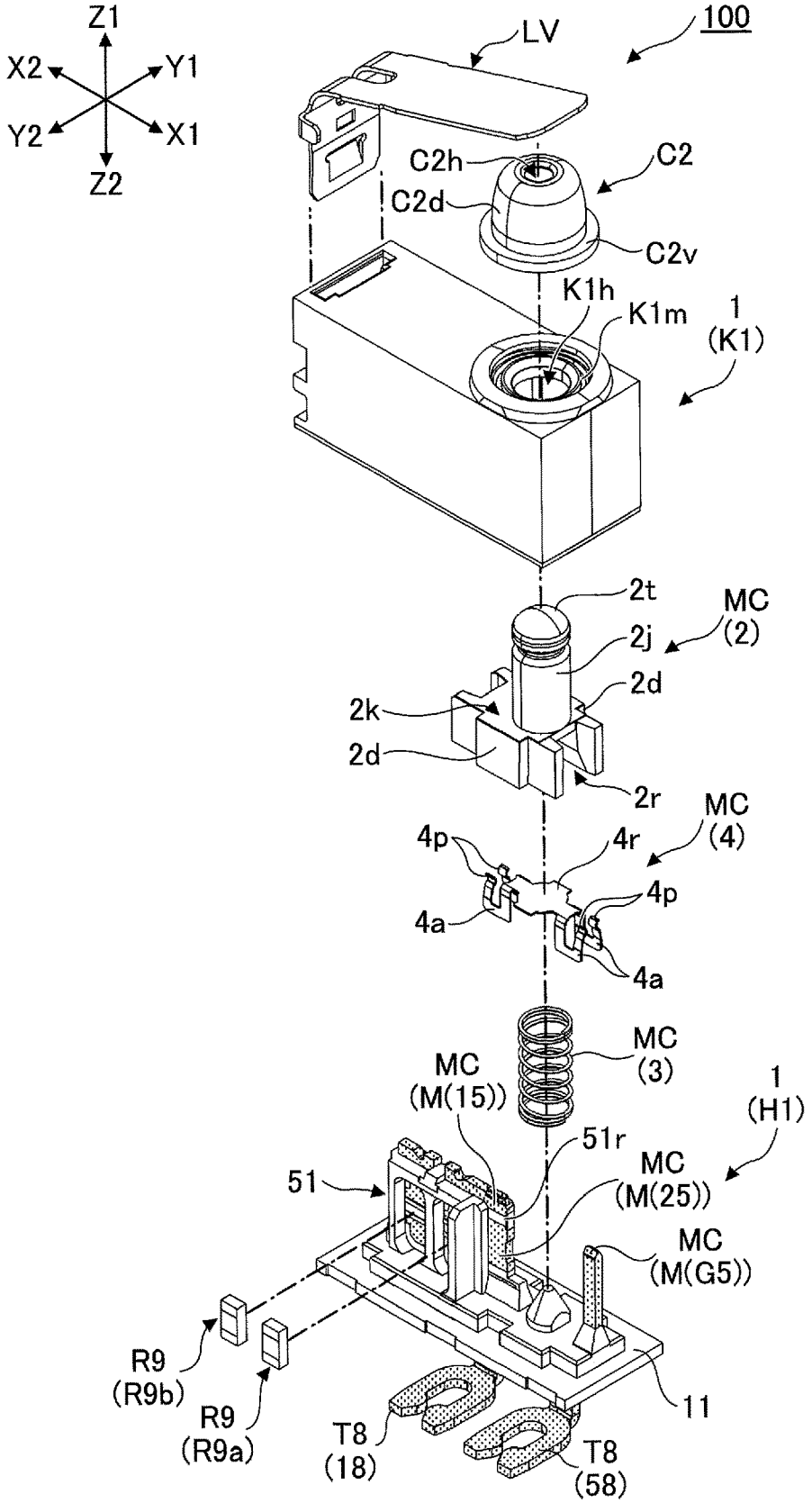
FIG. 1 is an exploded perspective view of a switch.
Figure 2A:
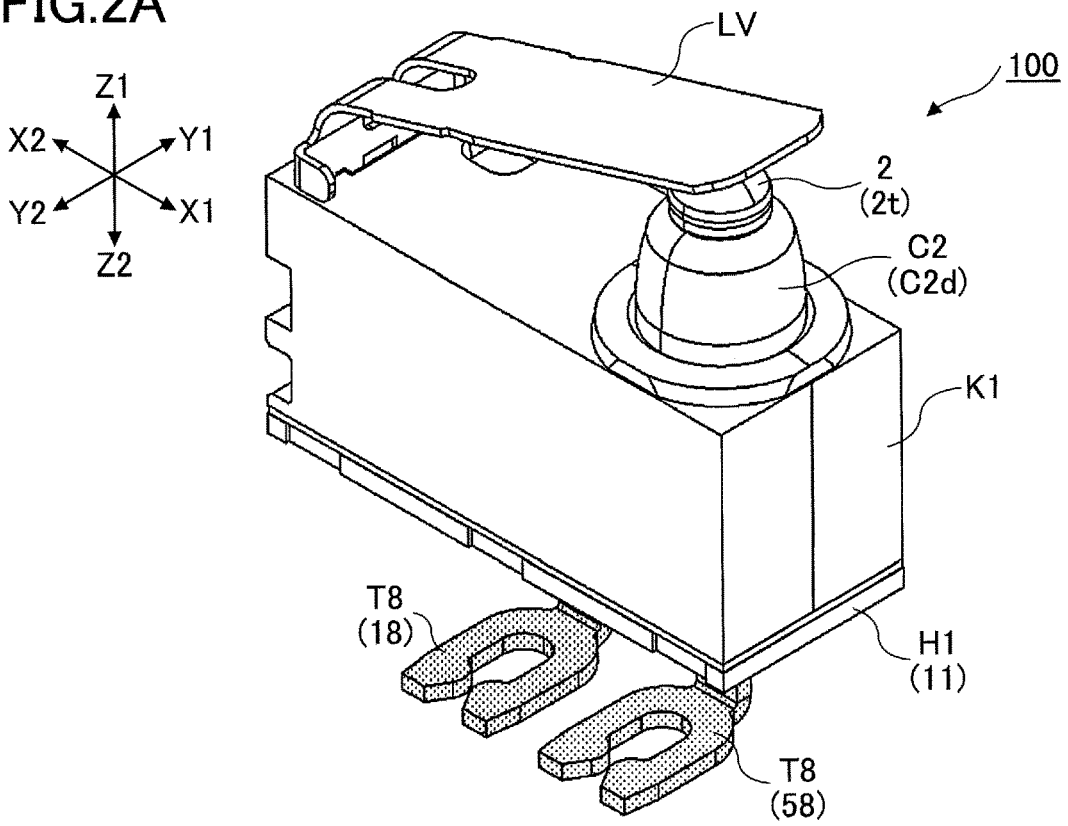
FIGS. 2A and 2B are a top perspective view and a bottom perspective view of the switch.
Figure 2B:
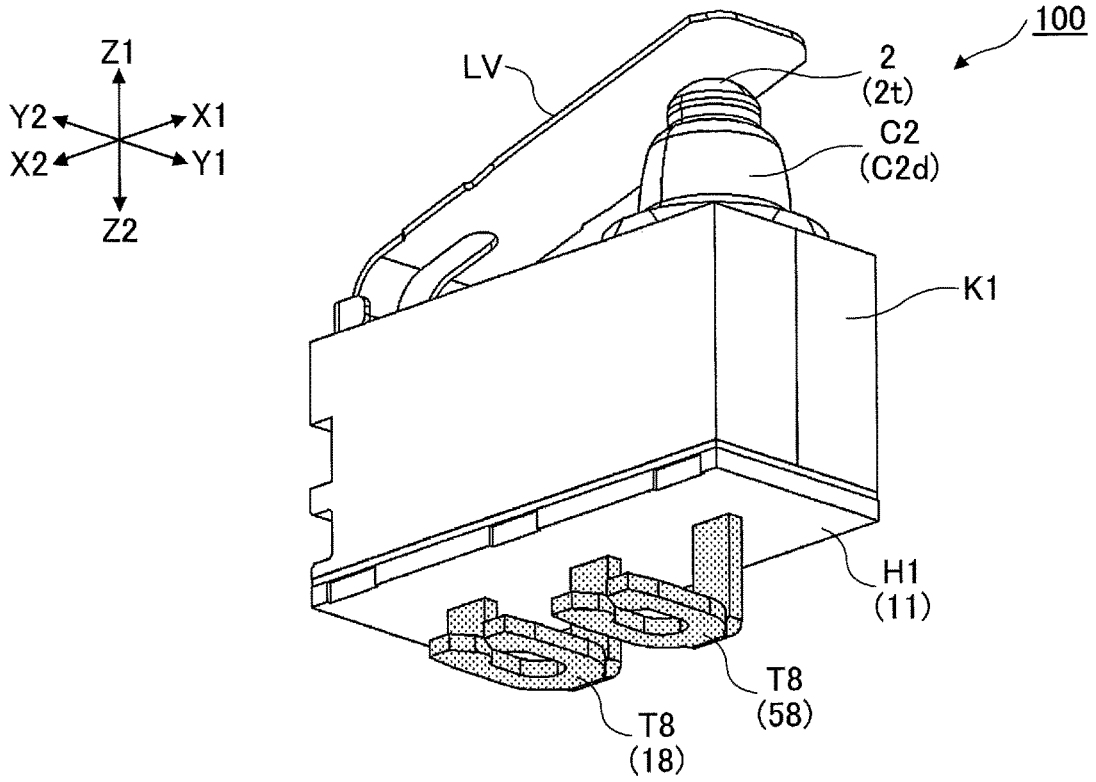
Figure 3A:
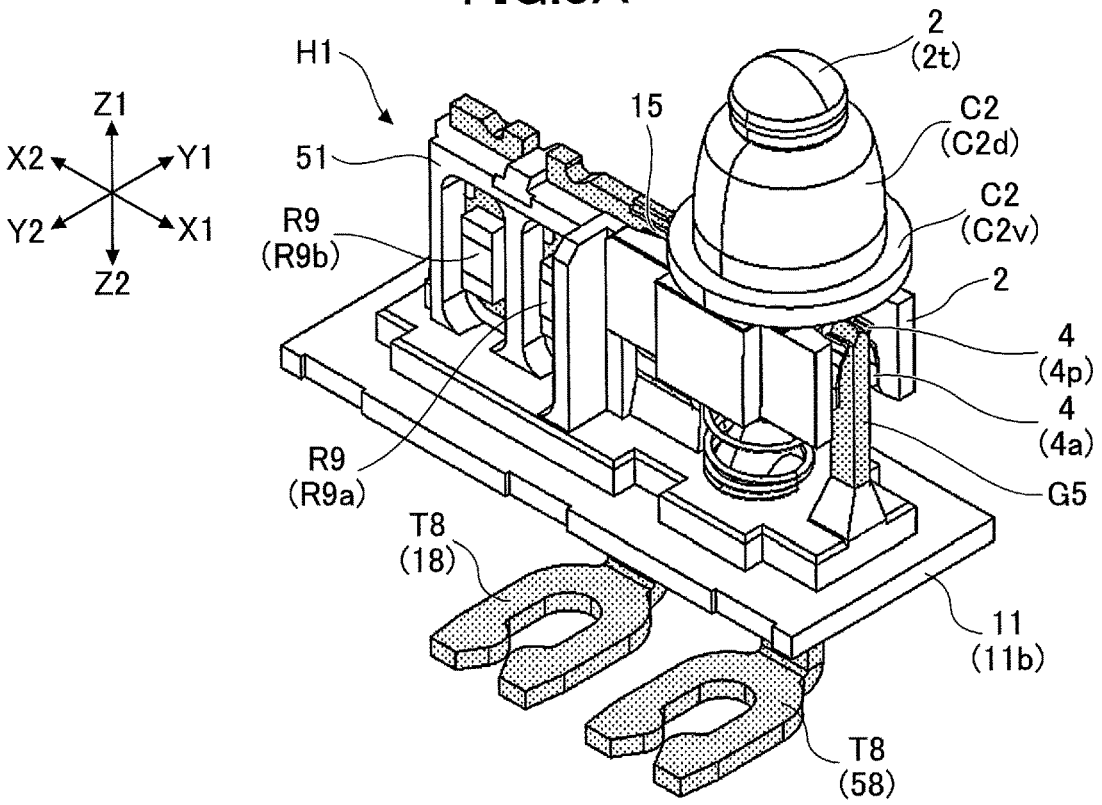
FIGS. 3A and 3B are a perspective view and a front view of the switch from which a case and a lever are removed.
Figure 3B:
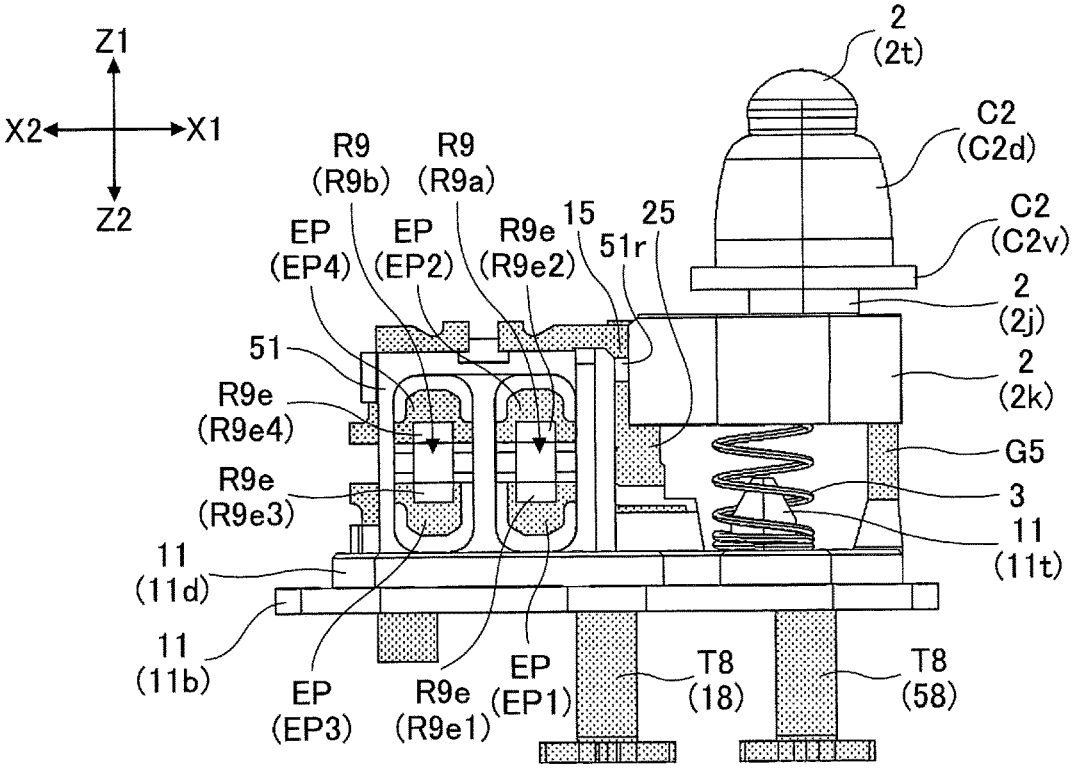
Figure 4A:
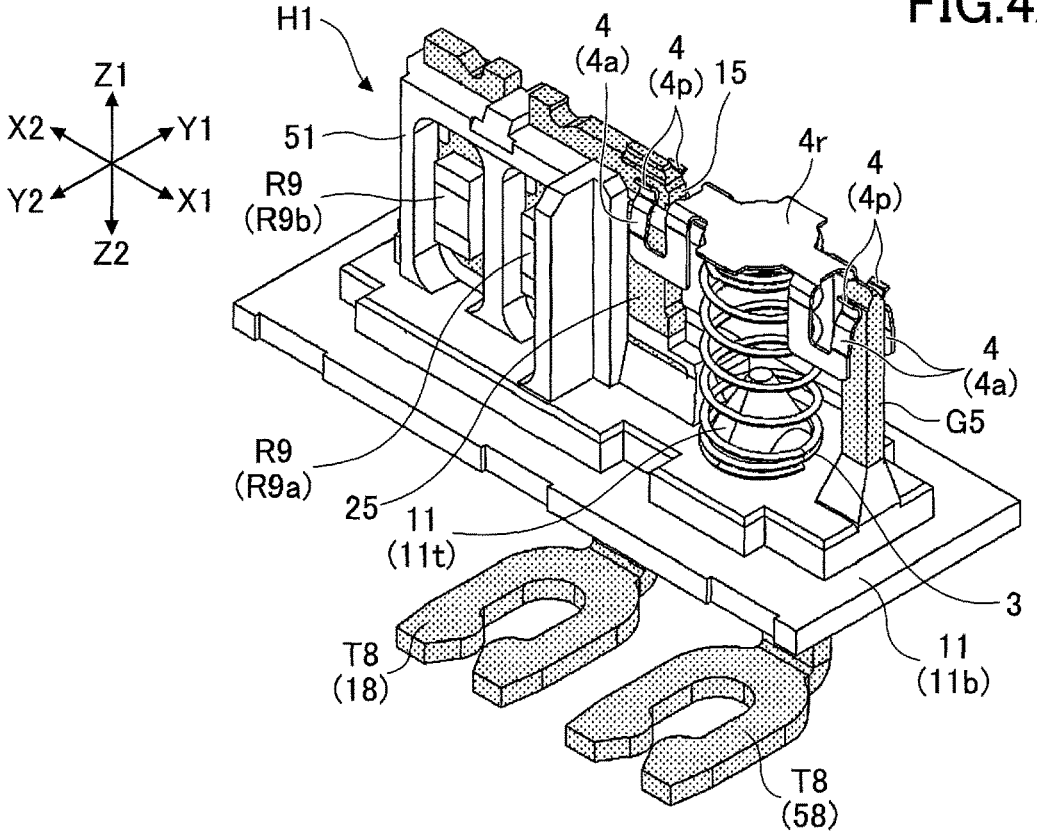
FIGS. 4A and 4B are perspective views of the switch from which some components are removed.
Figure 4B:
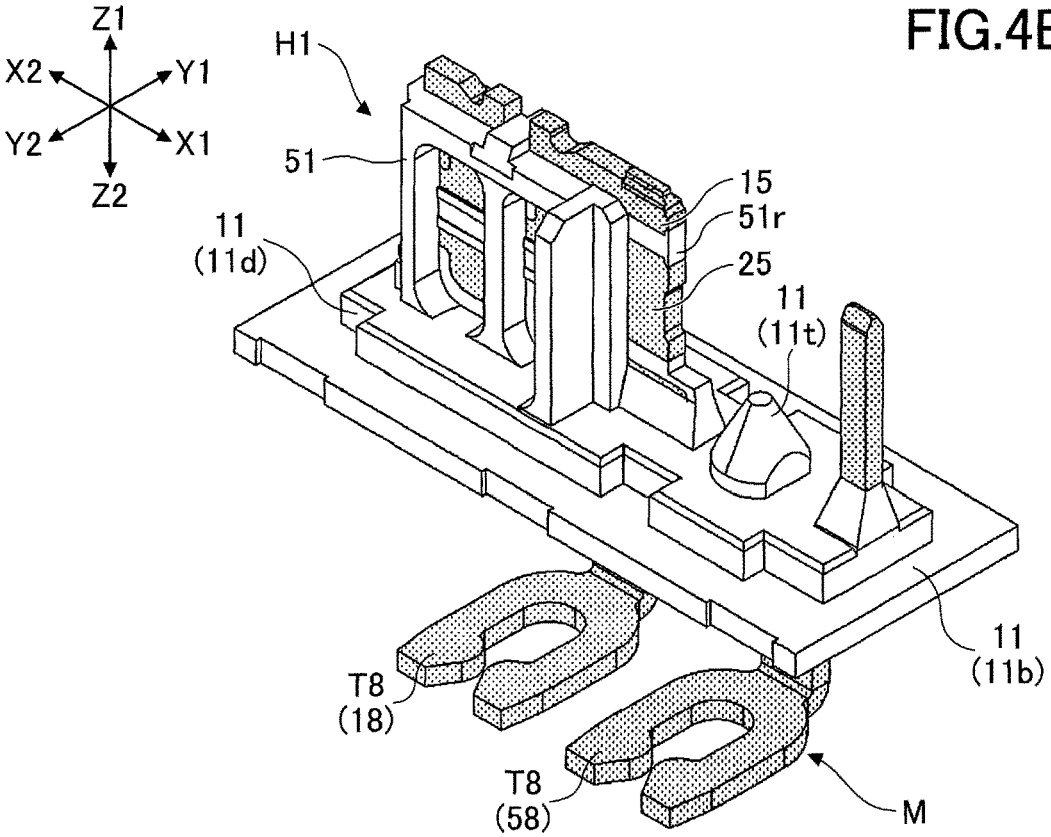

An embodiment of the present invention is described below with reference to the accompanying drawings. FIG. 1 is an exploded perspective view of a switch 100. FIG. 2A is a top perspective view of the switch 100, and FIG. 2B is a bottom perspective view of the switch 100. FIG. 3A is a top perspective view of the switch 100 from which a case K1 and a lever LV are removed, and FIG. 3B is a front view of the switch 100 from which the case K1 and the lever LV are removed. FIG. 4A is a top perspective view of the switch 100 from which a cover C2 and a moving part 2 are further removed, and FIG. 4B is a top perspective view of the switch 100 from which a biasing part 3 and a resistor R9 are further removed. Each of FIGS. 2A, 2B, 3A, 3B, and 4A illustrates the switch 100 in an initial state where an operation part 2*t* is not pressed.

The switch 100 includes a housing 1 having a box-like outer shape, a switching mechanism MC that switches the state of connection between at least two terminals T8 extending out of the housing 1 by using a common contact and two switching contacts, and electronic components (resistors R9) that are disposed in the housing 1 and electrically connect the terminals T8 to each other.

The switching mechanism MC is partially housed in the housing 1 and includes a moving part 2 that moves when the operation part 2*t* is pressed, a biasing part 3 that causes the pressed moving part 2 to return to the initial state where the moving part 2 is not pressed, a movable contact 4 that moves along with the movement of the moving part 2, and a metal plate M that provides the common contact and the two switching contacts.

The metal plate M includes a common fixed contact G5 used as a common contact that is continuously in contact with the movable contact 4, a first switching fixed contact 15 and a second switching fixed contact 25 used as switching contacts that contact and move away from the movable contact 4 according to operations of the operation part 2*t*, and the terminals T8 extending out of the housing 1.

In the present embodiment, the electronic components are resistors R9 for providing resistance between the two terminals T8. The resistors R9 include a first resistor R9*a* and a second resistor R9*b*.

The switch 100 further includes a lever LV for operating (pressing) the operation part 2*t* and a cover C2 disposed on the upper side of the housing 1 (on the Z1 side in FIG. 2).

Figure 5A:
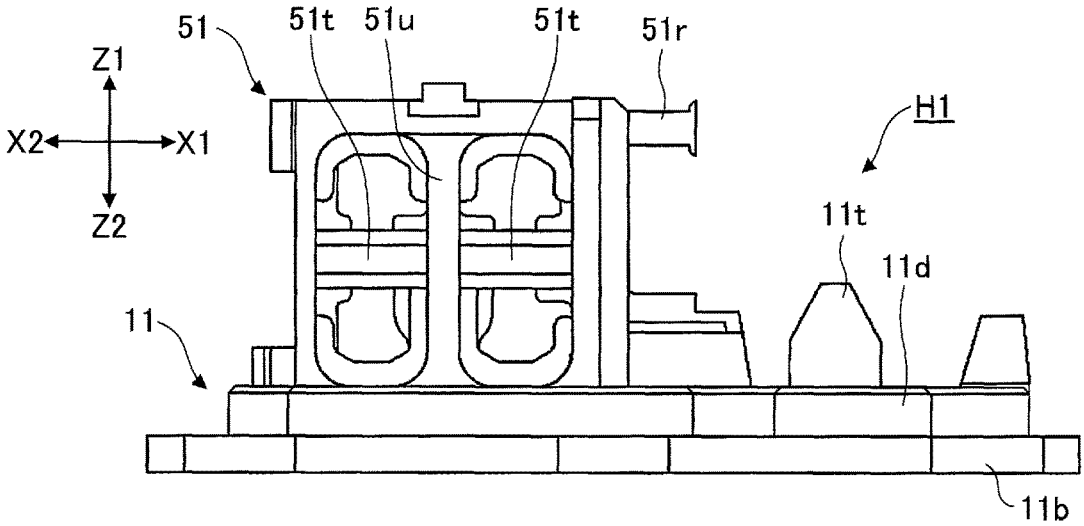
FIGS. 5A-5C are a front view, a rear view, and a right-side view of a holding part.
Figure 5B:
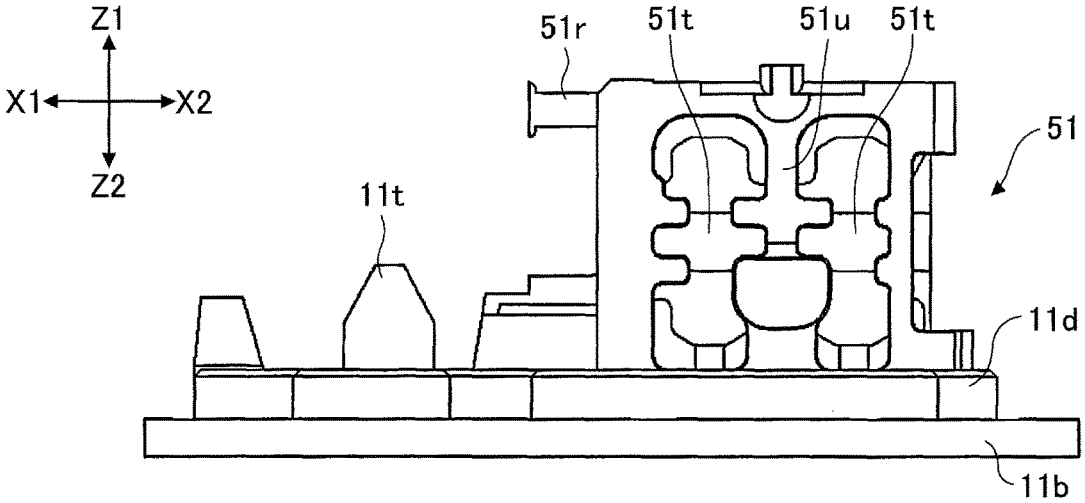
Figure 5C:
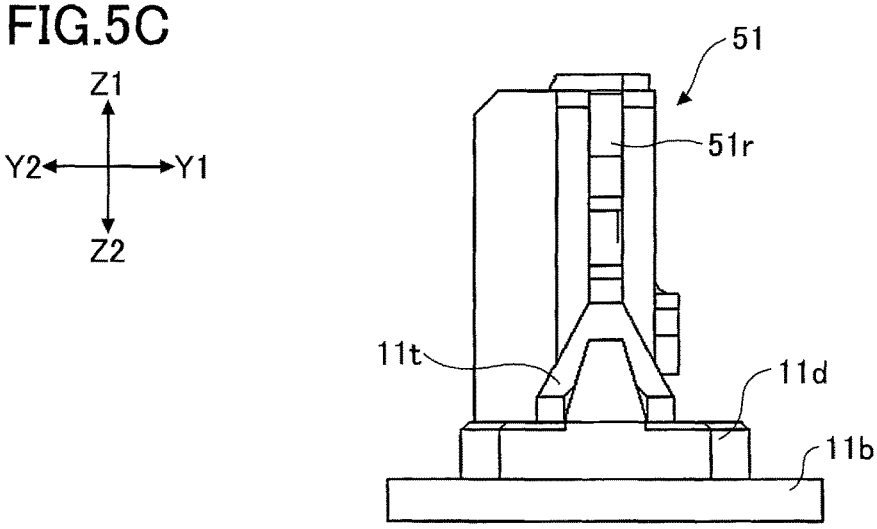
Figure 6:
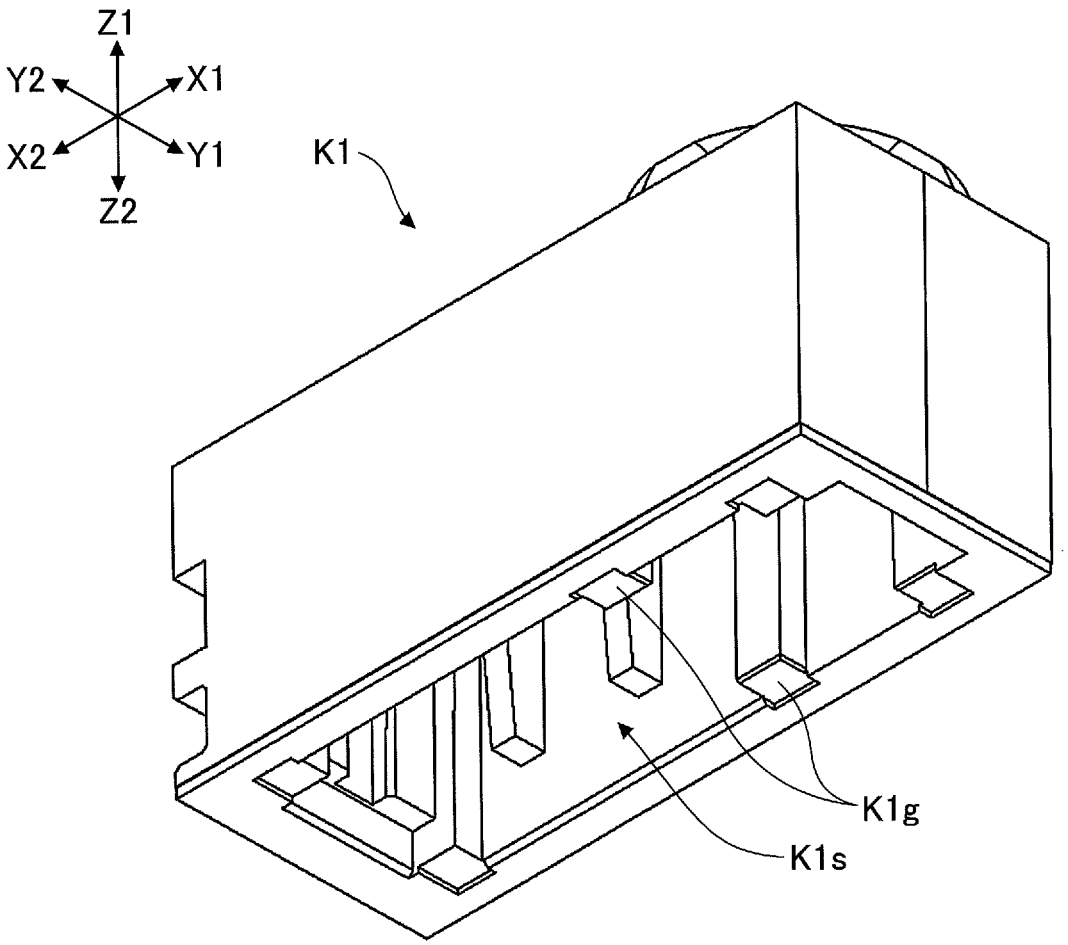
FIG. 6 is a bottom perspective view of a case.
Figure 7:
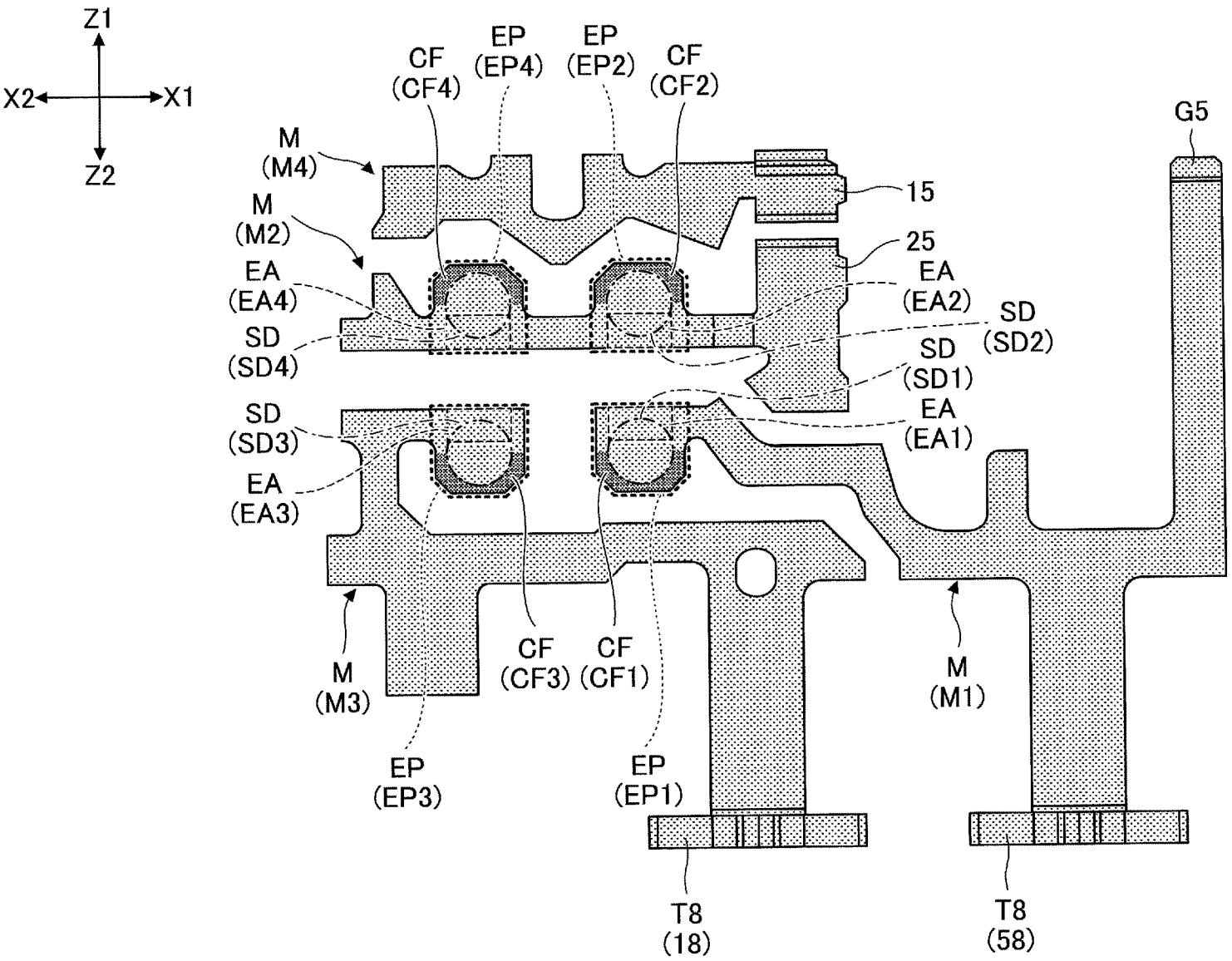
FIG. 7 is a front view of a metal plate.
Figure 8:
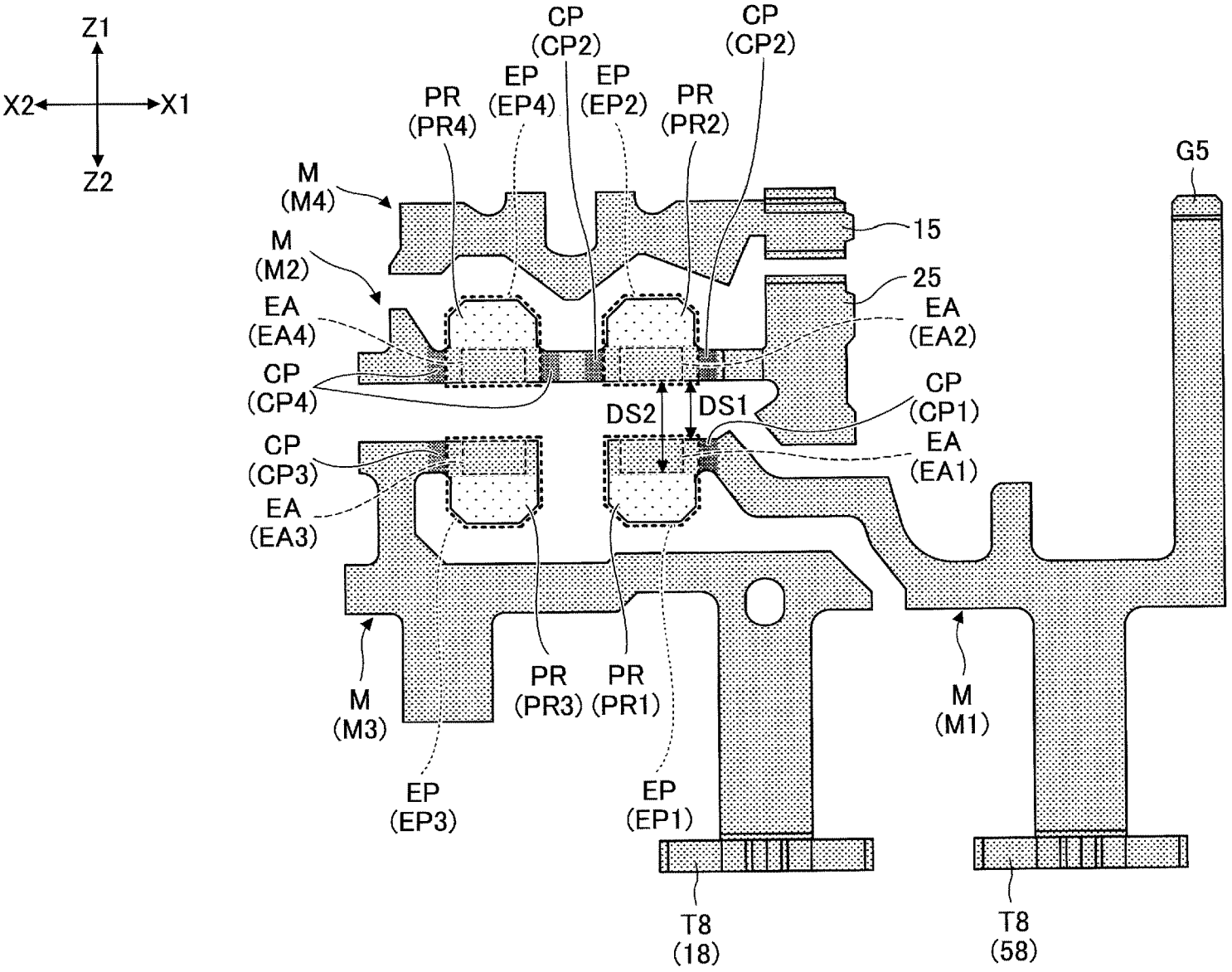
FIG. 8 is a front view of a metal plate.

Next, components of the switch 100 are described in more detail. FIG. 5A is a front view of a holding part H1 seen from the Y2 side in FIG. 1. FIG. 5B is a rear view of the holding part H1 seen from the Y1 side in FIG. 1, and FIG. 5C is a right-side view of the holding part H1 seen from the X1 side in FIG. 1. FIG. 6 is a bottom perspective view of the case K1. FIGS. 7 and 8 are front views of the metal plate M that is partially embedded in the holding part H1.

The housing 1 of the switch 100 is formed of a synthetic resin material and includes the holding part H1 in which the metal plate M is embedded as illustrated in FIG. 4B and the case K1 shaped like a box whose bottom is open as illustrated in FIG. 6. Also, in the housing 1, as illustrated in FIG. 2B, the holding part H1 is disposed to close the bottom of the case K1, and the holding part H1 and the case K1 are joined together.

As illustrated in FIGS. 4A through 6, the holding part H1 of the housing 1 includes a bottom wall 11 that closes the bottom of the case K1 (see FIG. 2B) and a holding wall 51 provided above the bottom wall 11.

As illustrated in FIG. 4B, the holding part H1 is formed by injection molding of a first synthetic resin material, and a part of the metal plate M is embedded in the holding part H1 by insert molding. The first synthetic resin material is, for example, a polybutylene terephthalate (PBT) resin containing glass fibers and having a heat distortion temperature between about 120 and about 220 degrees Celsius.

The heat distortion temperature is a temperature at which the amount of deflection of a sample of a synthetic resin material reaches a predetermined value when the temperature of the sample is increased while applying a predetermined load defined in a test method standard to the sample. The heat distortion temperature may also be referred to as a load deflection temperature. Here, because the melting temperature of a typical solder (lead-free solder) is between 217 and 220 degrees Celsius, the reflow temperature for reflow soldering is generally between 220 and 250 degrees Celsius.

As described later, the resistors R9 used as electronic components are bonded to the metal plate M by laser soldering. For this reason, the first synthetic resin material need not have a heat resistance property to withstand the reflow temperature. That is, the first synthetic resin material may be a thermoplastic synthetic resin material having a heat distortion temperature lower than the reflow temperature. For example, the first synthetic resin material may be a polyacetal resin (POM, polyoxymethylene) that does not contain glass fibers and have a heat distortion temperature between about 90 and 130 degrees Celsius, or a polyacetal resin (POM) containing glass fibers and having a heat distortion temperature between about 110 and 170 degrees Celsius. Also, the first synthetic resin material may be a thermoplastic synthetic resin material such as an acrylonitrile butadiene styrene (ABS) copolymer resin, a polycarbonate (PC) resin, or a polyethylene terephthalate (PET) resin. The synthetic resin to be used may be selected taking into account the environment where a product is to be used.

As illustrated in FIGS. 5A-5C, the holding wall 51 of the holding part H1 includes an insulation part 51*r* that extends outward from a frame-shaped part. As illustrated in FIG. 4B, the insulation part 51*r* is disposed between the first switching fixed contact 15 and the second switching fixed contact 25. This arrangement ensures insulation between the first switching fixed contact 15 and the second switching fixed contact 25. The Y1-side surface of the insulation part 51*r* and the Y1-side surfaces of the first switching fixed contact 15 and the second switching fixed contact 25 are aligned on the same plane. The same applies to the Y2-side surfaces of these components. Thus, there is no step between the first switching fixed contact 15 and the insulation part 51*r* and between the insulation part 51*r* and the second switching fixed contact 25. Accordingly, the movable contact 4 (contacts 4*p* described later) can move smoothly on the first switching fixed contact 15, the insulation part 51*r*, and the second switching fixed contact 25.

As illustrated in FIG. 5A, a frame-shaped inner portion of the holding wall 51 includes a first bar 51*t* and a second bar 51*u* are arranged to partition four exposed parts EP (see FIG. 7) to which the resistors R9 are soldered.

As illustrated in FIG. 4B, the bottom wall 11 of the holding part H1 includes a base 11*b* that is shaped like a rectangular flat plate and forms the bottom surface of the housing 1, a pedestal 11*d* inserted into a recess K1*s* (see FIG. 6) of the case K1, and an attaching part 11*t* having a conical trapezoidal shape and formed on the pedestal 11*d*.

Parts of the terminals T8 of the metal plate M are embedded in the base 11*b* and the pedestal 11*d* of the bottom wall 11, and the biasing part 3 is attached to the attaching part 11*t* of the bottom wall 11 as illustrated in FIG. 3B.

The case K1 of the housing 1 is formed by injection molding of the first synthetic resin material and is shaped like a box having the recess K1*s* that can house the moving part 2, the biasing part 3, and the movable contact 4 illustrated in FIG. 1.

In the present embodiment, the case K1 is formed using the same material as the holding part H1 (bottom wall 11) and is bonded to the holding part H1 by laser welding. This bonding method makes it possible to easily join the holding part H1 and the case K1 together, and also makes it possible to increase the adhesion and the bonding strength between the holding part H1 and the case K1. The bonding method can also increase the airtightness between the holding part H1 and the case K1.

As illustrated in FIG. 6, inside of the recess K1*s* of the case K1, guides K1*g* for guiding the moving part 2 are provided so that the moving part 2 can be reciprocated in the vertical direction (the Z direction in FIG. 2).

Also, as illustrated in FIG. 1, a through hole K1*h*, into which an operation shaft 2*j* of the moving part 2 is inserted, is formed in the upper surface of the case K1. The operation shaft 2*j* is configured to protrude upward from the through hole K1*h* of the case K1.

As illustrated in FIG. 2A, the cover C2 for covering the protruding operation shaft 2*j* is disposed above the through hole K1*h*. As illustrated in FIG. 1, a groove K1*m* that engages with a lower part (a flange C2*v*) of the cover C2 is provided around the through hole K1*h*. The cover C2 is hermetically coupled to the groove K1*m*.

As described above, the housing 1 is formed by joining the case K1 and the holding part H1 together, and the holding wall 51 is disposed in a sealed space formed by the case K1 and the bottom wall 11. Thus, the switch 100 is configured such that the holding wall 51 is not exposed out of the housing 1.

Next, the moving part 2 of the switch 100 is described. As illustrated in FIG. 1, the moving part 2 of the switch 100 includes an operation base 2*k* that holds the movable contact 4 in the housing 1, the operation shaft 2*j* protruding from the upper surface of the operation base 2*k*, and the operation part 2*t* formed at an end of the operation shaft 2*j*. The moving part 2 is configured to move in the vertical direction (in the Z-axis direction) when the operation part 2*t* is pressed by the lever LV.

The operation base 2*k* includes a recess 2*r* for housing the movable contact 4, and a connecting base 4*r* of the movable contact 4 is joined to the ceiling of the recess 2*r* by, for example, swaging. Steps 2*d* protruding outward are formed on the side surfaces of the operation base 2*k*. The steps 2*d* engage with the guides K1*g* (see FIG. 6) provided in the recess K1*s* of the case K1 such that the moving part 2 can move in the vertical direction.

As illustrated in FIG. 1, the operation shaft 2*j* of the moving part 2 has a substantially cylindrical shape. The operation shaft 2*j* is inserted into the through hole K1*h* of the case K1 and protrudes upward from the case K1.

The operation part 2*t* of the moving part 2 is formed at an end of the operation shaft 2*j* and is exposed through the top part of the cover C2 as illustrated in FIG. 2A. A joint portion between the operation shaft 2*j* and the operation part 2*t* is indented, and the top part of the cover C2 is hermetically coupled to the joint portion. The operation part 2*t*, which is the tip of the moving part 2, is pressed by, for example, an actuator (not shown) via the lever LV. The moving part 2 is formed by injection molding of a synthetic resin such as an acrylonitrile butadiene styrene (ABS) copolymer resin, a polycarbonate (PC) resin, or a polyacetal resin (POM, polyoxymethylene). Typically, the operation base 2*k*, the operation shaft 2*j*, and the operation part 2*t* are formed as a monolithic component.

Next, the cover C2 of the switch 100 is described. The cover C2 of the switch 100 is formed of a flexible elastic material such as silicone rubber. As illustrated in FIG. 1, the cover C2 includes the flange C2*v* that is fitted into the groove K1*m* of the case K1, a dome C2*d* formed seamlessly with the flange C2*v*, and a through hole C2*h* formed in substantially the center of the dome C2*d*.

The cover C2 is disposed on the upper surface of the case K1 to cover the through hole K1*h*, the flange C2*v* is fitted into the groove K1*m*, and the joint portion between the operation shaft 2*j* and the operation part 2*t* is fitted into the through hole C2*h*. With this configuration, the operation part 2*t*, which is an end portion of the operation shaft 2*j*, is exposed through the through hole C2*h* of the cover C2. The case K1 may be configured such that the flange C2*v* can be firmly fixed to the case K1 by deforming a ring-shaped resin wall provided around the groove K1*m* of the case K1 inward with a swage.

The dome C2*d* of the cover C2 is thin and configured to be smoothly inverted or deformed according to the vertical movement of the operation part 2*t* (the operation shaft 2*j*), and is therefore does not adversely affect the movement of the moving part 2. With this configuration, the cover C2 can prevent the entry of, for example, dust and moisture into the interior of the switch 100.

As illustrated in FIG. 4A, the biasing part 3 of the switch 100 is implemented by a common coil spring. One end of the biasing part 3 is attached to and supported by the attaching part 11*t* of the holding part H1, and the other end of the biasing part 3 is in contact with the connecting base 4*r* of the movable contact 4. Thus, the biasing part 3 is configured to elastically bias the moving part 2 and the movable contact 4 upward.

The biasing part 3 is disposed between the common fixed contact G5 and the first and second switching fixed contacts 15 and 25. With this arrangement, the biasing part 3 can hold the movable contact 4 in a well-balanced manner, and enables the movable contact 4 to stably contact the common fixed contact G5, the first switching fixed contact 15, and the second switching fixed contact 25.

When the operation part 2*t* is pressed by, for example, an actuator (not shown) via the lever LV, the coil spring used as the biasing part 3 is compressed along with the movement of the moving part 2 and the movable contact 4. When the pressure on the operation part 2*t* is released, the moving part 2 and the movable contact 4 are pushed upward by the force stored in the compressed coil spring and returned to the initial state. The biasing part 3 may be implemented by a component other than a coil spring as long as the component has a function to return the moving part 2 to the initial state before the operation. For example, the biasing part 3 may be implemented by a leaf spring or a rubber part.

As illustrated in FIG. 4A, the movable contact 4 of the switch 100 is formed by bending an elastic conductive metal plate. Specifically, the movable contact 4 includes the connecting base 4*r* shaped like a flat plate, four elastic arms 4*a* connected to each other via the connecting base 4*r*, and contacts 4*p* provided at the ends of the elastic arms 4*a*. The conductive metal plate is formed of, for example, copper, iron, or an alloy including copper or iron as a major component. The surface of the metal plate is plated with, for example, nickel or silver.

Two of the four elastic arms 4*a* are disposed at one end (the X1 end) of the connecting base 4*r* to face the common fixed contact G5, and the other two of the four elastic arms 4*a* are disposed at another end (the X2 end) of the connecting base 4*r* to face the first switching fixed contact 15 and the second switching fixed contact 25. Each elastic arm 4*a* has a substantially U-shape when seen from the Y2 side, and the end of the elastic arm 4*a* extends upward.

In the initial state of the moving part 2 where the operation part 2*t* is not pressed, two of the four contacts 4*p* (first contacts 4*p*) are disposed to contact the common fixed contact G5, and the other two of the four contacts 4*p* (second contacts 4*p*) are disposed to contact the first switching fixed contact 15 but not to contact the second switching fixed contact 25.

In a switched state of the moving part 2 where the operation part 2*t* is pressed, the first contacts 4*p* are disposed to contact the common fixed contact G5, and the second contacts 4*p* are disposed to contact the second switching fixed contact 25 but not to contact the first switching fixed contact 15.

Next, the metal plate M is described. The metal plate M is formed of, for example, a conductive metal such as iron, copper, or an alloy including iron or copper as a major component. In the present embodiment, the metal plate M is formed of phosphor bronze. The first switching fixed contact 15, the second switching fixed contact 25, the common fixed contact G5, and the terminals T8 are formed as parts of the metal plate M. As illustrated in FIG. 7, the first switching fixed contact 15, the second switching fixed contact 25, and the common fixed contact G5 are formed by punching one plated metal plate M such that these components become separate contacts. Alternatively, the metal plate M may be plated after being punched. The first switching fixed contact 15, the second switching fixed contact 25, and the common fixed contact G5 are embedded in the holding part H1 by insert molding before they are separated. Because the first switching fixed contact 15, the second switching fixed contact 25, and the common fixed contact G5 are made from the same metal plate M, they are arranged substantially in the same plane.

In the initial state of the moving part 2 where the operation part 2*t* is not pressed, the first switching fixed contact 15 is in contact with the second contacts 4*p* of the movable contact 4. When the operation part 2*t* is pressed and the moving part 2 changes to the switched state, the second contacts 4*p* move away from the first switching fixed contact 15.

In the initial state of the moving part 2, the second switching fixed contact 25 is not in contact with the second contacts 4*p*. When the operation part 2*t* is pressed and the moving part 2 changes to the switched state, the second contacts 4*p* contact the second switching fixed contact 25.

The common fixed contact G5 is in contact with the first contacts 4*p* of the movable contact 4 regardless of whether the moving part 2 is in the initial state or the switched state.

Specifically, as illustrated in FIG. 7, the metal plate M includes a first metal plate M1, a second metal plate M2, a third metal plate M3, and a fourth metal plate M4. The first metal plate M1 includes the common fixed contact G5 and a common terminal 58 that is one of the terminals T8. The second metal plate M2 includes the second switching fixed contact 25. The third metal plate M3 includes a normally-open terminal 18 that is another one of the terminals T8. The fourth metal plate M4 includes the first switching fixed contact 15.

The first metal plate M1 includes a first exposed part EP1 to which a first electrode R9*e*1 (see FIG. 3B) of the first resistor R9*a* is soldered. In FIG. 7, the first exposed part EP1 is surrounded by a bold dotted line. The first exposed part EP1 is exposed through the frame-shaped inner portion of the holding wall 51 even after the first metal plate M1 is partially embedded in the holding part H1 by insert molding. The same applies to a second exposed part EP2, a third exposed part EP3, and a fourth exposed part EP4.

The second metal plate M2 includes the second exposed part EP2 to which a second electrode R9*e*2 (see FIG. 3B) of the first resistor R9*a* is soldered and the fourth exposed part EP4 to which a fourth electrode R9*e*4 (see FIG. 3B) of the second resistor R9*b* is soldered.

The third metal plate M3 includes the third exposed part EP3 to which a third electrode R9*e*3 (see FIG. 3B) of the second resistor R9*b* is soldered.

The holding wall 51 of the holding part H1 is configured to hold each of the first metal plate M1, the second metal plate M2, and the third metal plate M3 such that the four exposed parts EP (the first through fourth exposed parts EP1-EP4) are exposed.

The terminals T8 are configured to extend downward (in the Z2 direction) from the bottom wall 11. Specifically, the terminals T8 includes the normally-open terminal 18 that is electrically connected to the second switching fixed contact 25 via the second resistor R9*b*, and the common terminal 58 that is electrically connected to the second switching fixed contact 25 via the first resistor R9*a*. With this configuration, the normally-open terminal 18 is electrically connected to the common terminal 58 via the first resistor R9*a* and the second resistor R9*b*.

In the present embodiment, each of the exposed parts EP includes an electrode mounting part EA on which the electrode R9*e* of the resistor R9 is placed, a soldering part SD on which solder is placed, and a peripheral part CF disposed along the edge of the soldering part SD. In FIG. 7, a rectangular area corresponding to the electrode mounting part EA is indicated by a dotted line, a circular area corresponding to the soldering part SD is indicated by a dashed-dotted line, and a U-shaped area corresponding to the peripheral part CF is indicated by dark (fine) dot hatching.

Specifically, the first exposed part EP1 includes a first electrode mounting part EA1 on which the first electrode R9*e*1 of the first resistor R9*a* is placed, a first soldering part SD1 on which solder for bonding the first electrode R9*e*1 of the first resistor R9*a* to the first exposed part EP1 is placed, and a first peripheral part CF1 disposed along the edge of the first soldering part SD1. The second exposed part EP2 includes a second electrode mounting part EA2 on which the second electrode R9*e*2 of the first resistor R9*a* is placed, a second soldering part SD2 on which solder for bonding the second electrode R9*e*2 of the first resistor R9*a* to the second exposed part EP2 is placed, and a second peripheral part CF2 disposed along the edge of the second soldering part SD2. The third exposed part EP3 includes a third electrode mounting part EA3 on which the third electrode R9*e*3 of the second resistor R9*b* is placed, a third soldering part SD3 on which solder for bonding the third electrode R9*e*3 of the second resistor R9*b* to the third exposed part EP3 is placed, and a third peripheral part CF3 disposed along the edge of the third soldering part SD3. The fourth exposed part EP4 includes a fourth electrode mounting part EA4 on which the fourth electrode R9*e*4 of the second resistor R9*b* is placed, a fourth soldering part SD4 on which solder for bonding the fourth electrode R9*e*4 of the second resistor R9*b* to the fourth exposed part EP4 is placed, and a fourth peripheral part CF4 disposed along the edge of the fourth soldering part SD4.

The soldering part SD is disposed to partially overlap the electrode mounting part EA. This arrangement indicates that a portion of the solder placed on the soldering part SD covers a portion of the electrode of the resistor R9 placed on the electrode mounting part EA.

In the present embodiment, the peripheral part CF has a U-shape. Specifically, the peripheral part CF is disposed along the semicircle of the outer side of the substantially circular soldering part SD (i.e., the side of the soldering part SD opposite the side on which the electrode mounting part EA is located). The outer shape of the peripheral part CF substantially corresponds to a part of a concentric circle of the circle indicating the area of the soldering part SD. That is, the peripheral part CF is configured to include a portion that has a shape similar to the outer shape of the soldering part SD such that no portion of the peripheral part CF is distant from the soldering part SD. Typically, the peripheral part CF has a curved shape without any corner.

With the U-shaped peripheral part CF, heat supplied to the exposed part EP by laser irradiation during laser soldering can be efficiently transferred to the entire exposed part EP. Thus, this configuration makes it possible to quickly increase the temperature of the entire exposed part EP to a desired temperature and to maintain the desired temperature for a desired time period. This in turn makes it possible to stably and efficiently solder the electrodes of the resistor R9 to the exposed part EP.

Next, the metal plate M is further described with reference to FIG. 8. FIG. 8 is a front view of the same metal plate M illustrated in FIG. 7. Different from FIG. 7, FIG. 8 illustrates the metal plate M such that protruding parts PR also included in the exposed parts EP are distinguishable from connecting parts CP that connect the exposed parts EP to other parts (parts other than the exposed parts EP) of the metal plate M. In FIG. 8, a rectangular area corresponding to the electrode mounting part EA is indicated by a dotted line, an area corresponding to the protruding part PR is indicated by a light (coarse) dot hatching, and an area corresponding to the connecting part CP is indicated by dark (fine) dot hatching.

Specifically, the first exposed part EP1 includes a first protruding part PR1 protruding from the first electrode mounting part EA1 in a direction (the Z2 direction) away from the second electrode mounting part EA2, and the second exposed part EP2 includes a second protruding part PR2 protruding from the second electrode mounting part EA2 in a direction (the Z1 direction) away from the first electrode mounting part EA1. The third exposed part EP3 includes a third protruding part PR3 protruding from the third electrode mounting part EA3 in a direction (the Z2 direction) away from the fourth electrode mounting part EA4, and the fourth exposed part EP4 includes a fourth protruding part PR4 protruding from the fourth electrode mounting part EA4 in a direction (the Z1 direction) away from the third electrode mounting part EA3.

The first metal plate M1 includes a first connecting part CP1 that connects the first exposed part EP1 to other parts (another part, or a remaining part) of the first metal plate M1. The second metal plate M2 includes second connecting parts CP2 that connect the second exposed part EP2 to other parts (another part, or a remaining part) of the second metal plate M2, and fourth connecting parts CP4 that connect the fourth exposed part EP4 to other parts (another part, or a remaining part) of the second metal plate M2. The third metal plate M3 includes a third connecting part CP3 that connects the third exposed part EP3 to other parts (another part, or a remaining part) of the third metal plate M3.

In the switch 100, the first connecting part CP1 is disposed closer to the second exposed part EP2 than the first protruding part PR1. That is, a distance DS1 in the Z-axis direction between the second exposed part EP2 and the first connecting part CP1 is less than a distance DS2 in the Z-axis direction between the second exposed part EP2 and the first protruding part PR1.

Similarly, the second connecting parts CP2 are disposed closer to the first exposed part EP1 than the second protruding part PR2, the third connecting part CP3 is disposed closer to the fourth exposed part EP4 than the third protruding part PR3, and the fourth connecting parts CP4 are disposed closer to the third exposed part EP3 than the fourth protruding part PR4.

In other words, the first protruding part PR1 protrudes in a direction away from the first connecting part CP1, the second protruding part PR2 protrudes in a direction away from the second connecting parts CP2, the third protruding part PR3 protrudes in a direction away from the third connecting part CP3, and the fourth protruding part PR4 protrudes in a direction away from the fourth connecting parts CP4. Also, the first protruding part PR1 and the second protruding part PR2 protrude in directions away from each other, and the third protruding part PR3 and the fourth protruding part PR4 protrude in directions away from each other.

The first exposed part EP1 and the second exposed part EP2 are preferably arranged symmetrically with respect to the first resistor R9*a* used as an electronic component, and the third exposed part EP3 and the fourth exposed part EP4 are preferably arranged symmetrically with respect to the second resistor R9*b* used as an electronic component. This arrangement makes it possible to prevent a so-called Manhattan effect where one of two soldered joints is pulled apart from the exposed part EP and one end of the electronic component is lifted due to the tension of the other one of the two soldered joints resulting from unbalanced melting of solder at the two soldered joints, and also makes it possible to suppress damage on the electronic component or the holding part H1 that is caused by the reflection of a laser beam from the surface of the exposed part EP.

Figure 9:
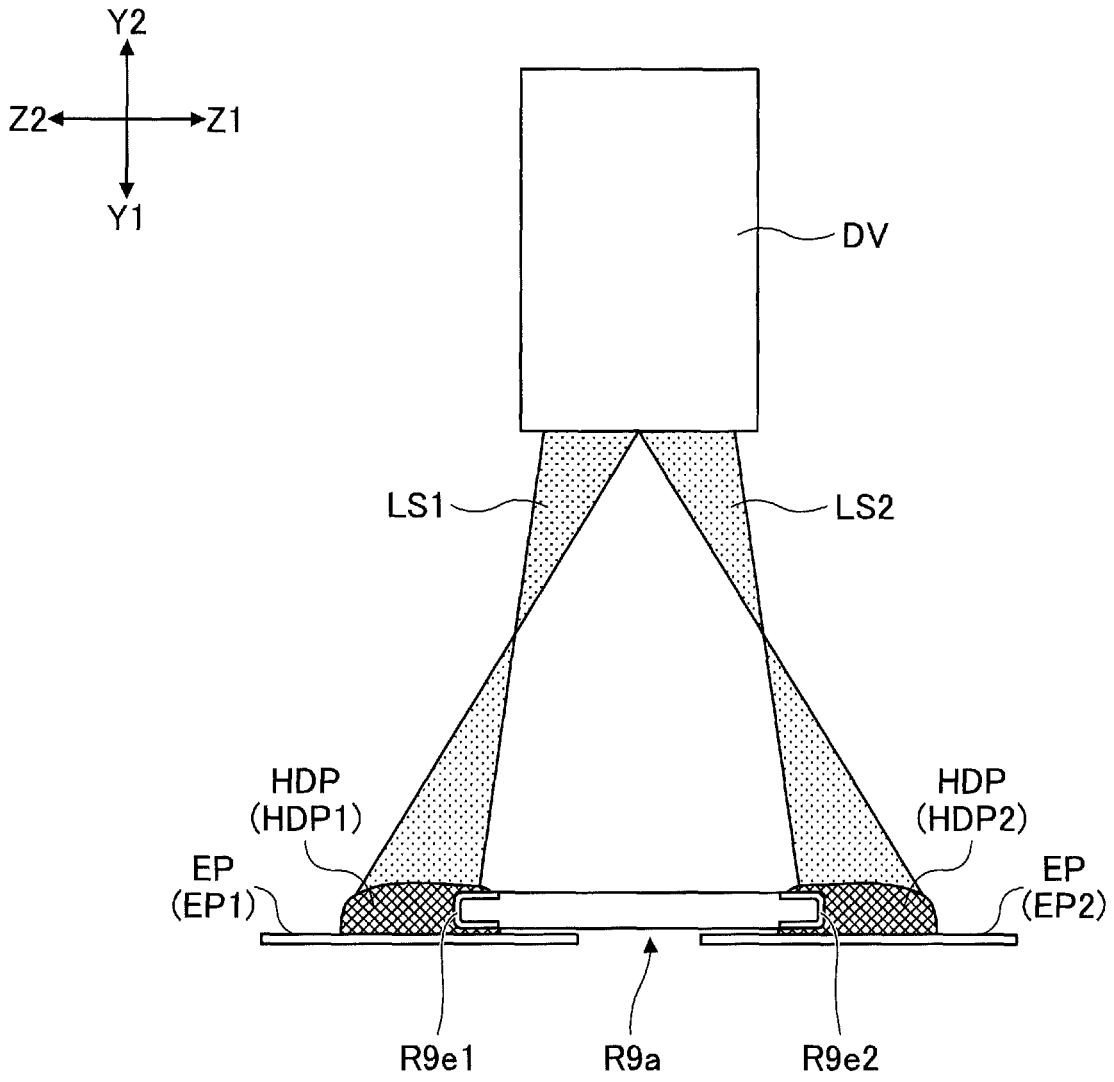
FIG. 9 is a drawing illustrating a laser soldering device.

FIG. 9 is a drawing illustrating an example of a configuration of a laser soldering device DV used for laser soldering. FIG. 9 illustrates a state where the soldering of the first electrode R9*e*1 of the first resistor R9*a* to the first exposed part EP1 and the soldering of the second electrode R9*e*2 of the first resistor R9*a* to the second exposed part EP2 are performed simultaneously by the laser soldering device DV. Specifically, the laser soldering device DV irradiates a solder paste HDP1 applied to a portion of the first exposed part EP1 and a portion of the first electrode R9*e*1 with a laser beam LS1 while irradiating a solder paste HDP2 applied to a portion of the second exposed part EP2 and a portion of the second electrode R9*e*2 with a laser beam LS2. The power of the laser beam LS1 is the same as the power of the laser beam LS2. As described above, the first exposed part EP1 and the second exposed part EP2 are arranged symmetrically. The same applies to the positional relationship between the first electrode R9*e*1 and the second electrode R9*e*2 of the first resistor R9*a*, the positional relationship between the solder paste HDP1 and the solder paste HDP2, and the positional relationship between a circular spot of the laser beam LS1 and a circular spot of the laser beam LS2. Therefore, the manner in which heat supplied by the irradiation of the laser beam LS1 is transferred through the first exposed part EP1 is substantially the same as the manner in which heat supplied by irradiation of the laser beam LS2 is transferred through the second exposed part EP2. That is, the laser soldering device DV can melt the solder contained in the solder paste HDP1 and the solder contained in the solder paste HDP2 at the same timing and in the same manner. Thus, with the laser soldering device DV, the substantially circular shape of the solder can be maintained even after the solder is melted. Also, the laser soldering device DV can suppress the movement (displacement) of the first resistor R9*a* caused by the melted solder, and thereby suppress or prevent the occurrence of the Manhattan effect. Further, the laser soldering device DV can suppress the unbalanced melting of the solder and thereby suppress or prevent the surface (coating) of the exposed part EP covered with the solder paste HDP from being exposed. This in turn makes it possible to suppress or prevent the electronic component or the holding part H1 from being damaged by the laser beam reflected from the surface of the exposed part EP.

Thus, the exposed part EP has such a shape that the heat supplied by laser irradiation (or heat stored in the exposed part EP) is less likely to escape from the exposed part EP.

In the present embodiment, the connecting part CP is positioned as far as possible from the exposed part EP where heat is to be stored. Specifically, the first connecting part CP1 is positioned closer to the second exposed part EP2 than the first protruding part PR1. More specifically, the first connecting part CP1 is disposed on the X1 side of the first electrode mounting part EA1. However, the first connecting part CP1 may instead be disposed on the X2 side or the Z1 side of the first electrode mounting part EA1.

The second connecting parts CP2 are positioned closer to the first exposed part EP1 than the second protruding part PR2. More specifically, the second connecting parts CP2 are disposed on the X1 side and the X2 side of the second electrode mounting part EA2. However, the second connecting part(s) CP2 may instead be disposed on the Z2 side of the second electrode mounting part EA2.

The third connecting part CP3 is positioned closer to the fourth exposed part EP4 than the third protruding part PR3. More specifically, the third connecting part CP3 is disposed on the X2 side of the third electrode mounting part EA3. However, the third connecting part CP3 may instead be disposed on the X1 side or the Z1 side of the third electrode mounting part EA3.

The fourth connecting parts CP4 are positioned closer to the third exposed part EP3 than the fourth protruding part PR4. More specifically, the fourth connecting parts CP4 are disposed on the X1 side and the X2 side of the fourth electrode mounting part EA4. However, the fourth connecting part(s) CP4 may instead be disposed on the Z2 side of the fourth electrode mounting part EA4.

The first exposed part EP1 is connected to the other parts only via the first connecting part CP1. In the present embodiment, the third exposed part EP3 is connected to the other parts only via the third connecting part CP3. The width of the connecting part CP is less than the width of the exposed part EP. Also, the width of the connecting part CP is less than the diameter of the soldering part SD (see FIG. 7).

Different from a case where an electronic component is soldered to a printed circuit board, when two electrodes of the resistor R9 used as an electronic component are soldered simultaneously to the metal plate M having a high thermal conductivity as in the present embodiment, it is important to control the manner of heat transfer in the metal plate M and the temperature distribution in the metal plate M. In the present embodiment, the U-shaped peripheral part CF is provided in the exposed part EP of the metal plate M so that heat is transferred in the exposed part EP in a desired manner and a desired temperature distribution is achieved in the exposed part EP.

Figure 10A:
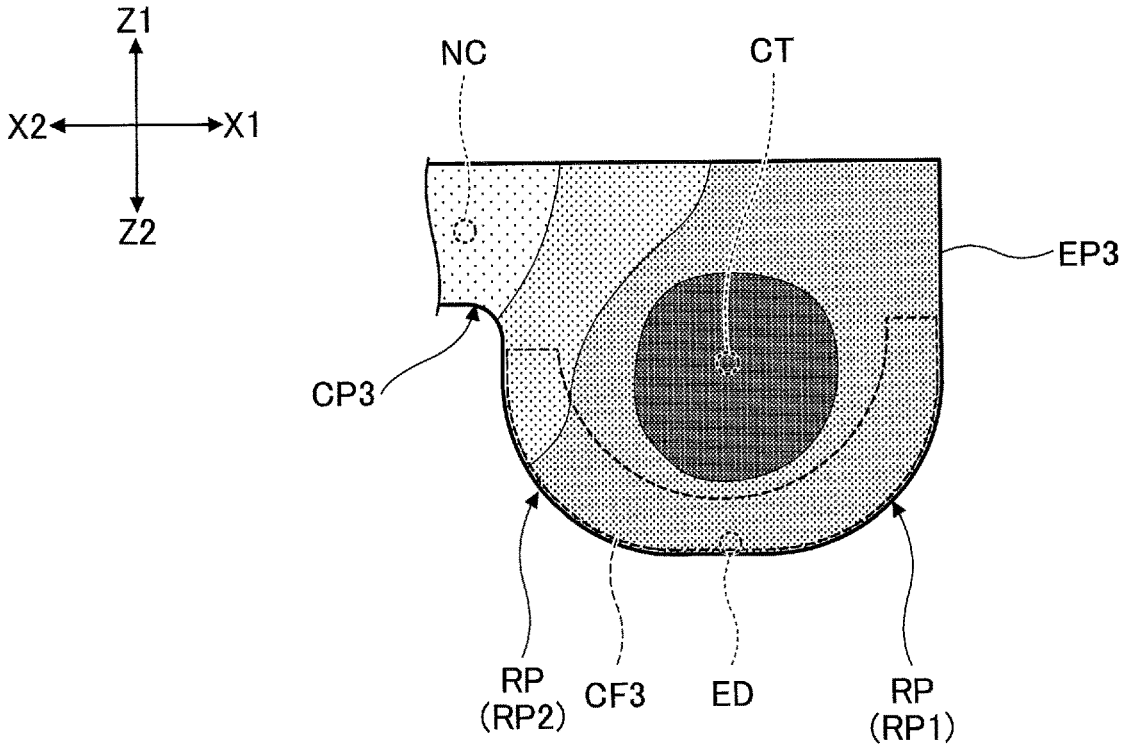
FIGS. 10A and 10B are enlarged views of exposed parts to which a resistor is soldered.
Figure 10B:
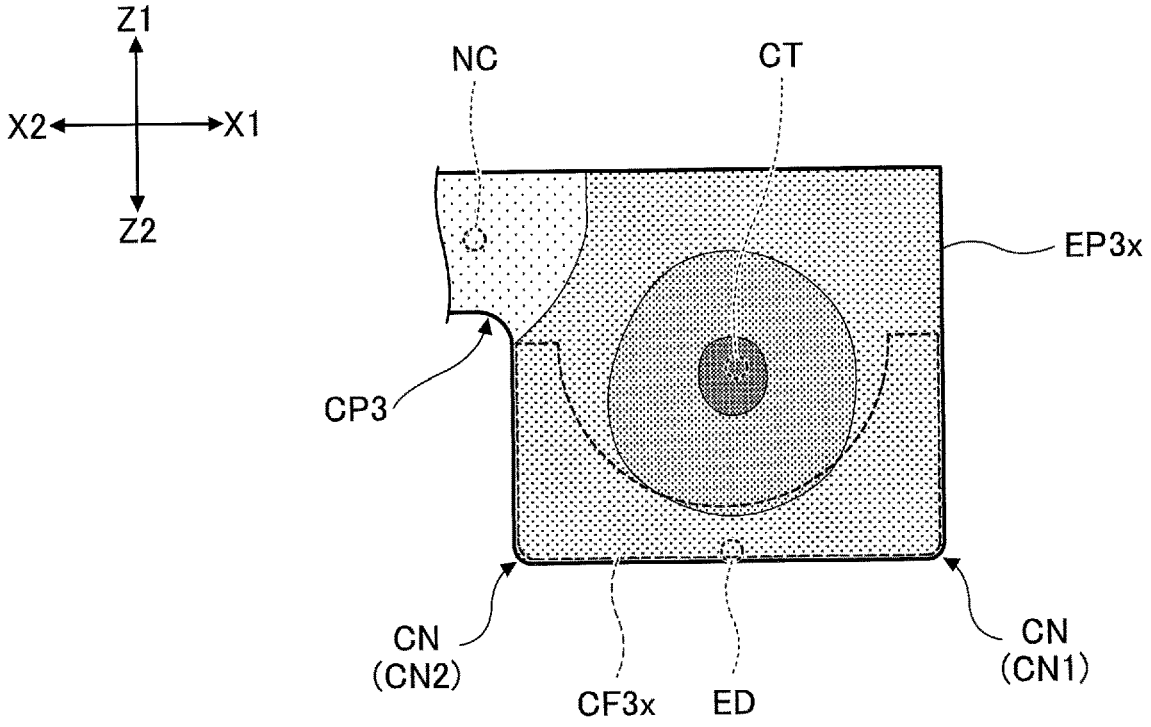

Effects of the U-shaped peripheral part CF are described in detail with reference to FIGS. 10A and 10B. FIG. 10A is an enlarged view of the third exposed part EP3 including the U-shaped third peripheral part CF3, and FIG. 10B is an enlarged view of a third exposed part EP3*x* including a third peripheral part CF3*x* with a square-bracket shape. The outer edge of the third peripheral part CF3 has a curved shape including curved parts RP (a first curved part RP1 and a second curved part RP2). On the other hand, the outer edge of the third peripheral part CF3*x* has an angular shape including corners CN (a first corner CN1 and a second corner CN2).

FIG. 10A illustrates the temperature distribution in the third exposed part EP3 observed when the third exposed part EP3 is irradiated with a laser beam whose spot center is at a center point CT for a predetermined time period, and FIG. 10B illustrates the temperature distribution in the third exposed part EP3*x* observed when the third exposed part EP3*x* is irradiated with a laser beam whose spot center is at a center point CT for the predetermined time period. In FIGS. 10A and 10B, the temperature distribution is indicated by differences in the density (or fineness) of the dot hatching. The darker (or finer) hatching indicates a higher temperature.

The temperature distribution of the third exposed part EP3 is described below. However, the descriptions below also apply to the first exposed part EP1, the second exposed part EP2, and the fourth exposed part EP4.

As is apparent from FIGS. 10A and 10B, the temperature of the third exposed part EP3 is higher than the temperature of the third exposed part EP3*x*. Specifically, in FIG. 10A, the temperature at the center point CT is 230 degrees Celsius, the temperature at an edge point ED is 214 degrees Celsius, and the temperature at a point NC on the third connecting part CP3 is 204 degrees Celsius. On the other hand, in FIG. 10B, the temperature at the center point CT is 223 degrees Celsius, the temperature at an edge point ED is 202 degrees Celsius, and the temperature at a point NC on the third connecting part CP3 is 197 degrees Celsius.

The differences in temperature are due to the presence or absence of the corners CN. As illustrated in FIG. 10A, in the case of the third exposed part EP3 that does not include the corners CN, heat supplied by laser irradiation is not transferred to the corners CN. On the other hand, as illustrated in FIG. 10B, in the case of the third exposed part EP3*x* having the corners CN, heat supplied by laser irradiation is transferred also to the corners CN. For this reason, the size of a portion of the third exposed part EP3*x* with a relatively high temperature (i.e., the portion with the darkest dot hatching) is significantly smaller than the size of a portion of the third exposed part EP3 with a relatively high temperature (i.e., the portion with the darkest dot hatching). That is, in the third exposed part EP3*x*, because the heat supplied by laser irradiation is unnecessarily transferred to the corners CN, the temperature of the third soldering part SD3 (see FIG. 7), which needs to be maintained at a high temperature, becomes lower than the temperature of the third soldering part SD3 of the third exposed part EP3.

Also, with the third exposed part EP3*x* that includes the corners CN as illustrated in FIG. 10B, molten solder flows into the corners CN, and the surface of the third exposed part EP3*x* that needs to be covered by the solder may be exposed. On the other hand, with the third exposed part EP3 that does not include the corners CN as illustrated in FIG. 10A, the molten solder does not flow into the corners CN, and the surface of the third exposed part EP3 that needs to be covered by the solder is not exposed. For the above reasons, the configuration of the third exposed part EP3 can suppress or prevent the surface (or coating) of the third exposed part EP3, which needs to be covered with solder, from being exposed. This in turn makes it possible to suppress or prevent an electronic component or the holding part H1 from being damaged by a laser beam reflected from the surface of the third exposed part EP.

Thus, compared with the configuration of the third exposed part EP3*x* including the corners CN, the configuration of the third exposed part EP3 including the third peripheral part CF3 having a shape formed by removing the corners CN makes it possible to efficiently supply heat to the third soldering part SD3 and maintain the third soldering part SD3 at a relatively high temperature. Also, compared with the configuration of the third exposed part EP3*x*, the configuration of the third exposed part EP3 can suppress or prevent the surface of the third exposed part EP3*x*, which needs to be covered with solder, from undesirably being exposed. That is, compared with the configuration of the third exposed part EP3*x*, the configuration of the third exposed part EP3 can suppress or prevent an unbalanced change of the shape of molten solder. Therefore, the configuration of the third exposed part EP3 having a curved shape including the curved parts RP makes it possible to stably solder the third electrode R9*e*3 of the second resistor R9*b* to the third exposed part EP3. Also, because the third exposed part EP3 has a shape formed by removing the corners CN, it is possible to prevent the amount of molten solder flowing toward the left side (X2 side) of the third electrode R9*e*3 of the second resistor R9*b* from being greatly different from the amount of molten solder flowing toward the right side (X1 side) of the third electrode R9*e*3. Accordingly, the configuration of the third exposed part EP3 makes it possible to prevent the second resistor R9*b* from being moved due to the difference in tension between the molten solder on the right side and the molten solder on the left side of the third electrode R9*e*3.

As described above, the metal plate M is held by the holding wall 51 such that the exposed parts EP are exposed through the frame-shaped inner portion of the holding wall 51. When the electrodes of the resistors R9 are placed on and soldered to the exposed parts EP, laser soldering is used instead of reflow soldering. Therefore, it is not necessary to place the holding part H1, in which the metal plate M is embedded and held, in a reflow furnace. Accordingly, the holding part H1 can be formed of, for example, a first synthetic resin material that is less expensive than a synthetic resin material that has a heat resistance property to withstand a reflow temperature.

In the switch 100, as illustrated in FIG. 2B, the entire perimeter of the base of the terminal T8 is surrounded by the first synthetic resin material forming the bottom wall 11. That is, the switch 100 is configured such that the entire perimeter of the base of the terminal T8 is in close contact with the bottom wall 11. This configuration makes it possible to prevent, for example, water from entering the switch 100 through a gap between the terminal T8 and the bottom wall 11. Further, the switch 100 is configured such that the holding wall 51 is disposed in an enclosed space formed by the case K1 and the bottom wall 11. This configuration also improves the waterproof property.

In the present embodiment, the resistors R9 are implemented by inexpensive general-purpose chip resistors. Also, the first resistor R9*a* and the second resistor R9*b* are selected to have different resistance values. The first electrode R9*e*1 of the first resistor R9*a* is bonded to the first exposed part EP1 by laser soldering, and the second electrode R9*e*2 of the first resistor R9*a* is bonded to the second exposed part EP2 by laser soldering. As a result, the second switching fixed contact 25 and the common terminal 58, which are separate from each other, are electrically connected to each other via the first resistor R9*a*. The third electrode R9*e*3 of the second resistor R9*b* is bonded to the third exposed part EP3 by laser soldering, and the fourth electrode R9*e*4 of the second resistor R9*b* is bonded to the fourth exposed part EP4 by laser soldering. As a result, the second switching fixed contact 25 and the normally-open terminal 18, which are separate from each other, are electrically connected to each other via the second resistor R9*b*. The resistors R9 may also be implemented by electronic components other than chip resistors, such as substrates on which carbon resistors are printed.

Figure 11:
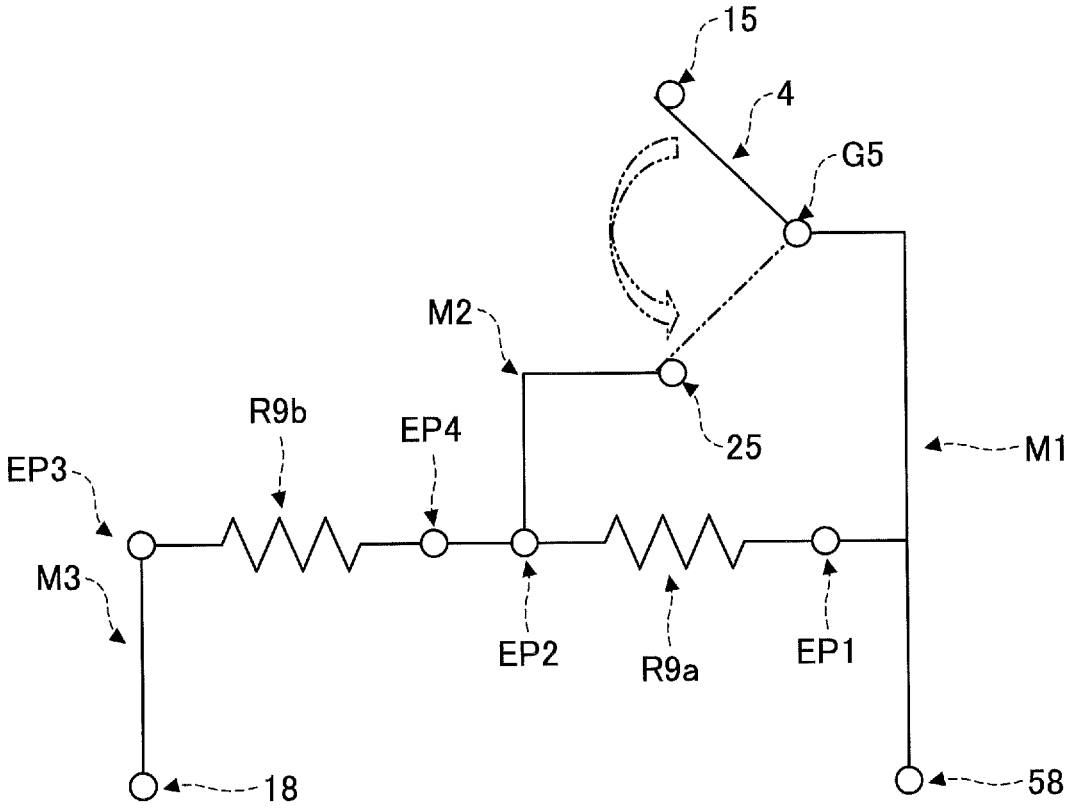
FIG. 11 is a diagram of a detection circuit of the switch.

Next, a detection circuit of the switch 100 is described. FIG. 11 is a diagram of a detection circuit of the switch 100. FIG. 11 illustrates a state of the detection circuit while the moving part 2 is in the initial state.

In the detection circuit of the switch 100, as illustrated in FIG. 11, the common fixed contact G5 connected to the common terminal 58 via the first metal plate M1 is connected to the first switching fixed contact 15 via the movable contact 4 when the moving part 2 is in the initial state. In the present embodiment, the first switching fixed contact 15 is a dummy contact that is not in contact with other parts. The common terminal 58 is connected to the normally-open terminal 18 via the first resistor R9*a* and the second resistor R9*b*. One end of the first resistor R9*a* is connected to the first exposed part EP1 of the first metal plate M1, and the other end of the first resistor R9*a* is connected to the second exposed part EP2 of the second metal plate M2. Also, one end of the second resistor R9*b* is connected to the third exposed part EP3 of the third metal plate M3, and the other end of the second resistor R9*b* is connected to the fourth exposed part EP4 of the second metal plate M2.

When the moving part 2 is in the initial state, the second switching fixed contact 25 is not connected to the common fixed contact G5 via the movable contact 4, but is connected to the common terminal 58 via the first resistor R9*a* and connected to the normally-open terminal 18 via the second resistor R9*b*.

When the operation part 2*t* is pressed, the movable contact 4 moves along with the movement of the moving part 2 and is connected to the second switching fixed contact 25. That is, the moving part 2 changes to the switched state. Then, when the pressure on the operation part 2*t* is released, the moving part 2 is pushed by the biasing part 3 back to the initial state. Thus, the moving part 2 is configured to be switched between the initial state and the switched state.

In the detection circuit of FIG. 11, when the moving part 2 is in the initial state, a combined resistance value, which is the sum of the resistance value of the first resistor R9*a* and the resistance value of the second resistor R9*b*, is detected between the normally-open terminal 18 and the common terminal 58. On the other hand, when the moving part 2 is in the switched state, only the resistance value of the second resistor R9*b* is detected between the normally-open terminal 18 and the common terminal 58. The On and Off of the switch 100 are determined based on the difference between the detected resistance values.

When, for example, an electric wire of an external device connected to the detection circuit is in an abnormal state (a disconnected state), the voltage from the external device is not applied to the common terminal 58 regardless of whether the moving part 2 is in the initial state or the switched state. In this case, the resistance value of the detection circuit from the viewpoint of the external device becomes infinite. On the other hand, when, for example, the electric wire of the external device is short-circuited, the power supply voltage supplied to the external device is applied to the common terminal 58 regardless of whether the moving part 2 is in the initial state or the switched state. That is, the resistance value of the detection circuit from the viewpoint of the external device becomes zero.

When, for example, the electric wire of the external device connected to the detection circuit is in a normal state, different voltages are applied to the common terminal 58 depending on the connection states of the movable contact 4. That is, when the moving part 2 is in the initial state, a voltage corresponding to a combined resistance value determined by the resistance value of the first resistor R9*a*, the resistance value of the second resistor R9*b*, and the resistance value of the external device is applied to the common terminal 58; and when the moving part 2 is in the switched state, a voltage corresponding to a combined resistance value determined by the resistance value of the second resistor R9*b* and the resistance value of the external device is applied to the common terminal 58. Accordingly, by detecting the voltage value (the resistance value) of the detection circuit, the switch 100 can determine whether the connection between the external device and the electric wire is in a normal state or an abnormal state.

Effects of the switch 100 configured as described above are summarized. First, in the switch 100, because the resistors R9 are mounted on the metal plate M by laser soldering, the holding part H1 holding the metal plate M including the first through fourth exposed parts EP1-EP4 is formed of the first synthetic resin material that is a thermoplastic synthetic resin material having a heat distortion temperature lower than the reflow temperature. For this reason, compared with a case where the holding part H1 is formed of a thermoplastic resin material having a heat distortion temperature higher than the reflow temperature, the switch 100 can be manufactured at a lower cost.

Also, in the switch 100, because both of the holding part H1 and the case K1 are formed of the first synthetic resin material, laser welding can be used to bond the holding part H1 (the bottom wall 11) to the case K1. Therefore, the holding part H1 and the case K1 can be easily joined together. This in turn makes it possible to further reduce the manufacturing cost of the switch 100. Further, using laser welding makes it possible to increase the adhesion and the bonding strength between the holding part H1 and the case K1. This in turn makes it possible to improve the airtightness between the holding part H1 and the case K1 of the switch 100.

The detection circuit of FIG. 11 is configured such that the first switching fixed contact 15 serves as a dummy contact. However, the detection circuit may also be configured such that the second switching fixed contact 25 serves as a dummy contact.

Figure 12:
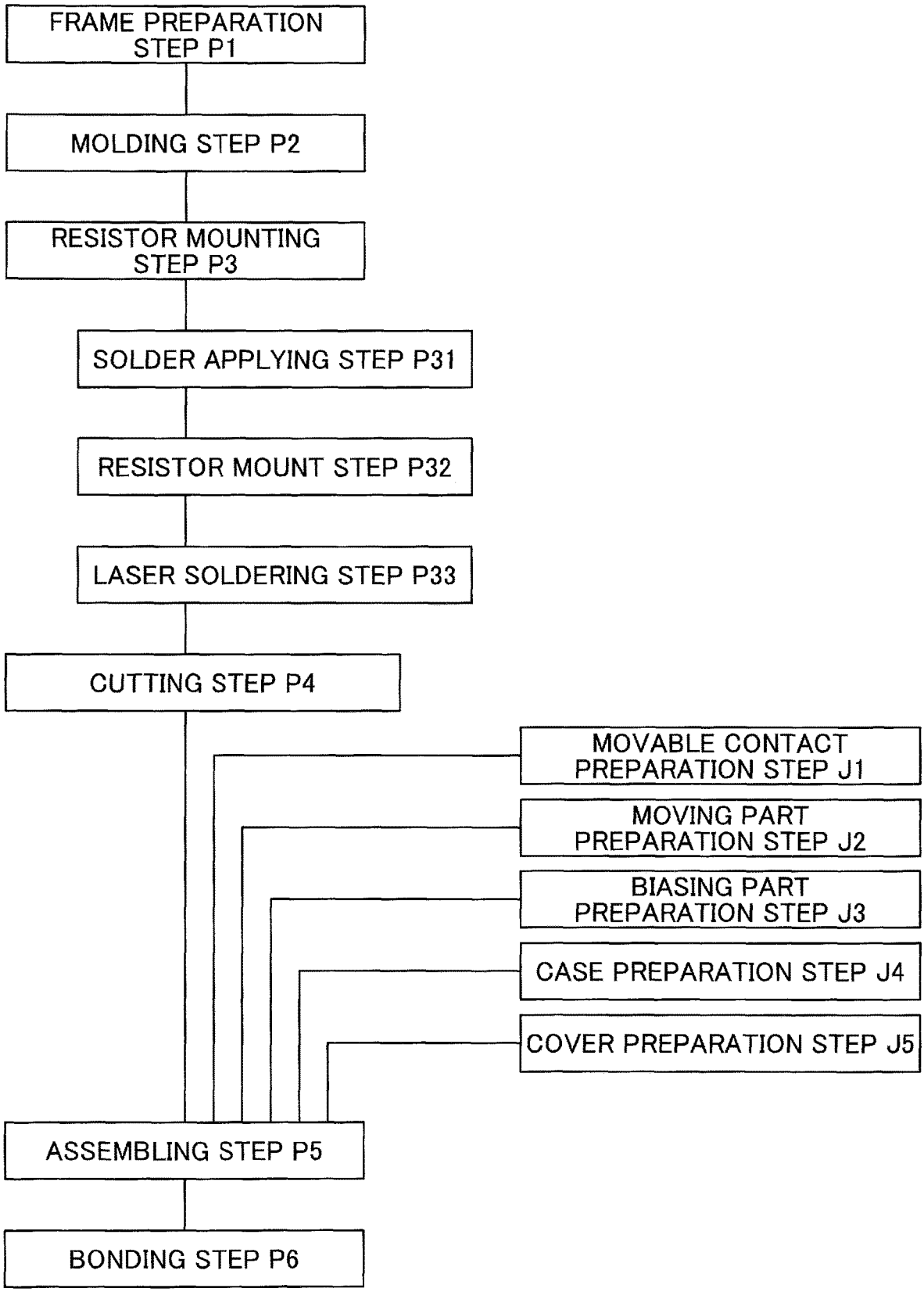
FIG. 12 is a flowchart illustrating a process of manufacturing the switch.
Figure 13A:
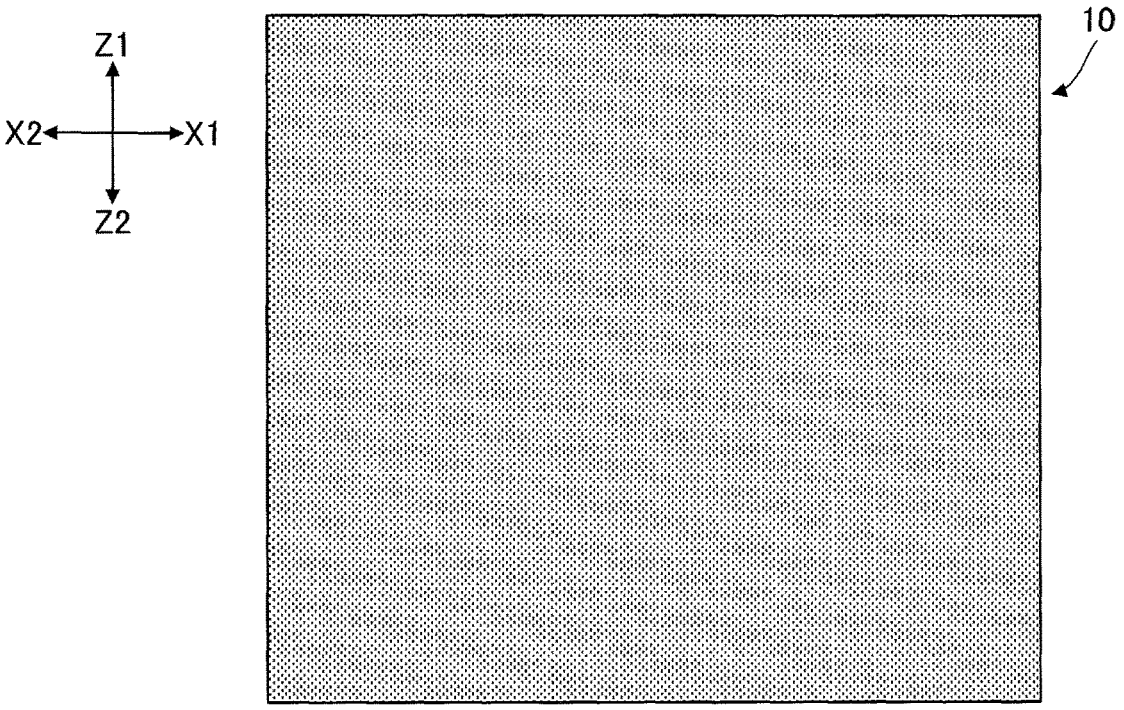
FIGS. 13A and 13B are front views of a metal plate before and after being punched.
Figure 13B:
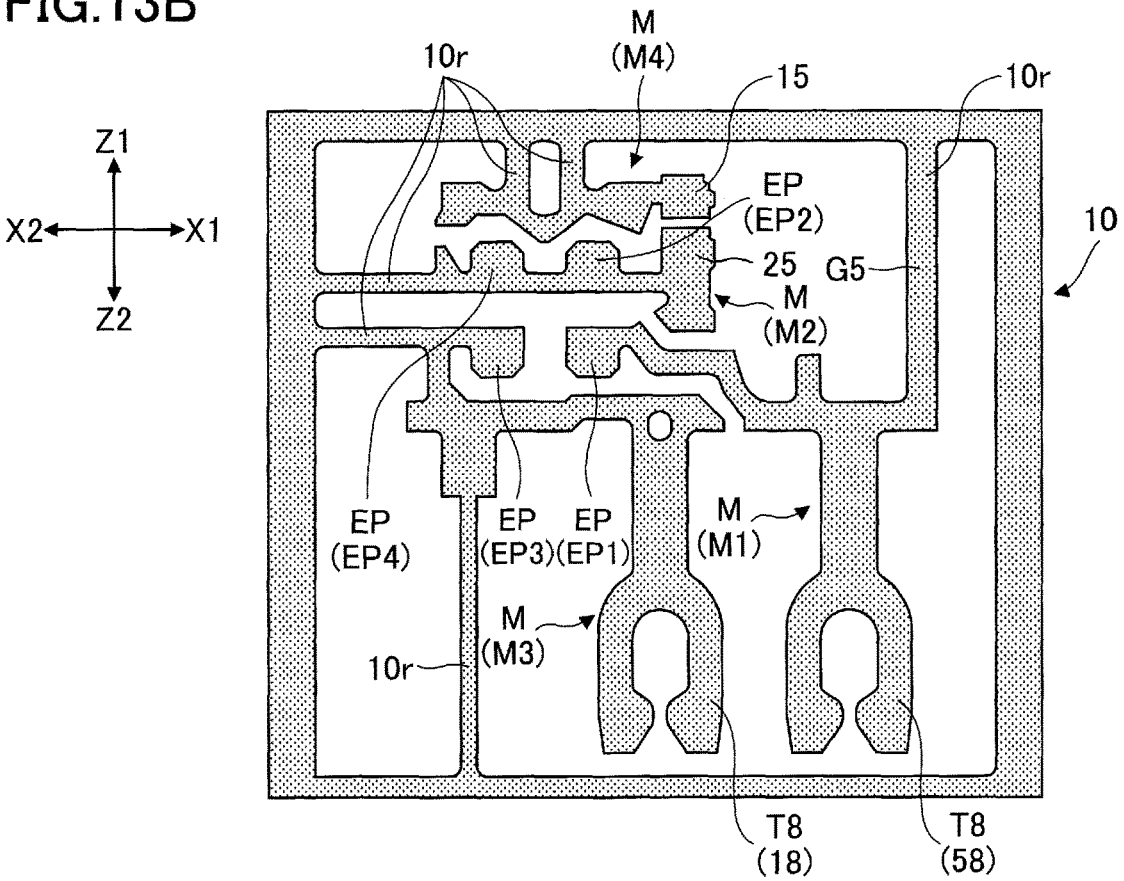
Figure 14:
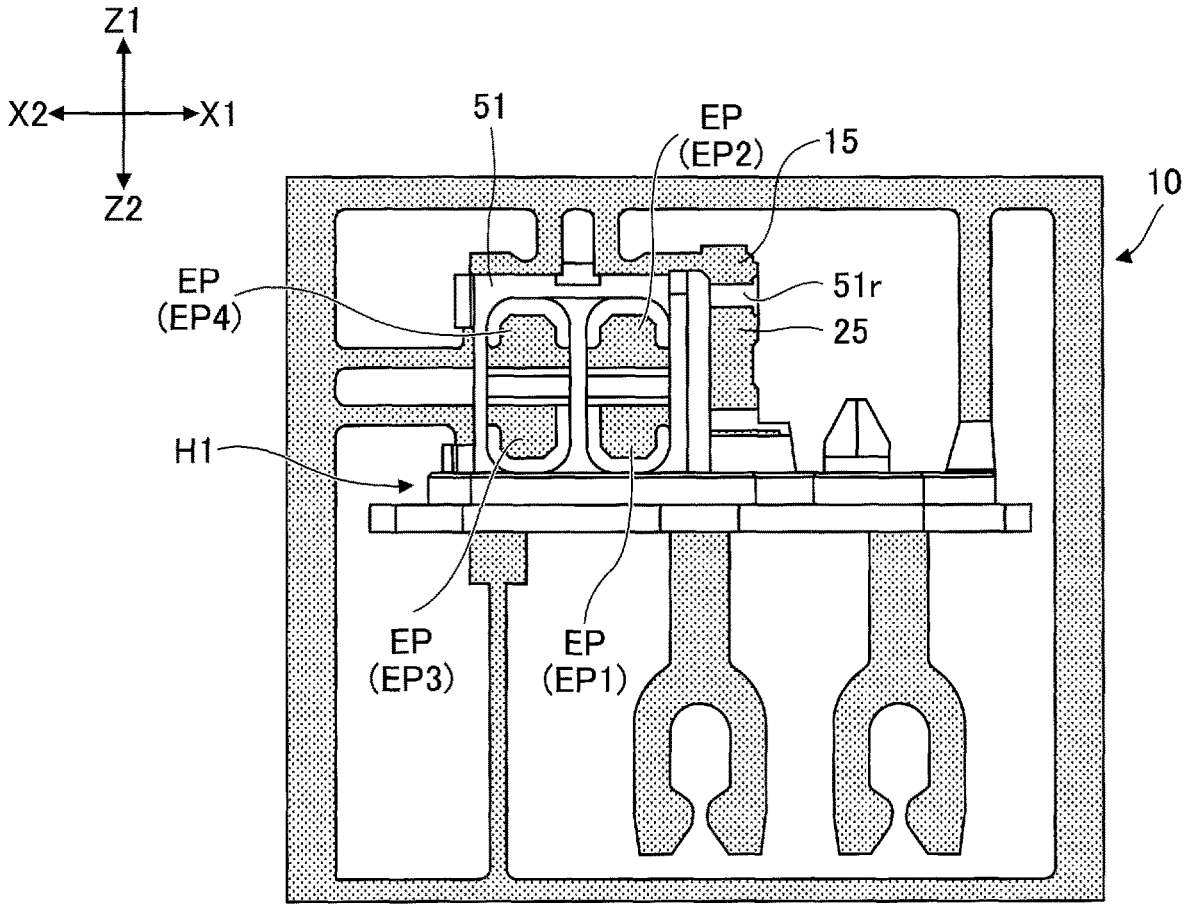
FIG. 14 is a front view of a metal plate after a molding step.
Figure 15:
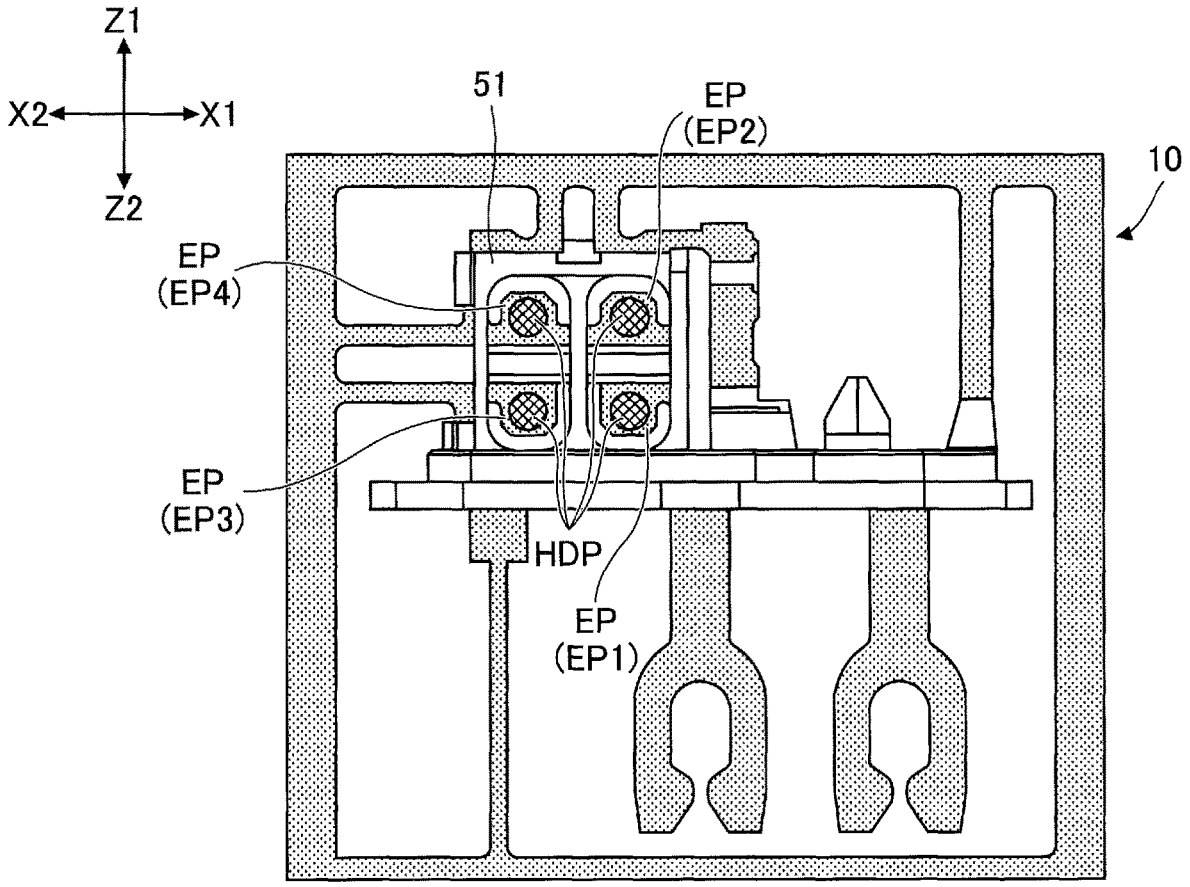
FIG. 15 is a front view of a metal plate after a solder applying step.
Figure 16A:
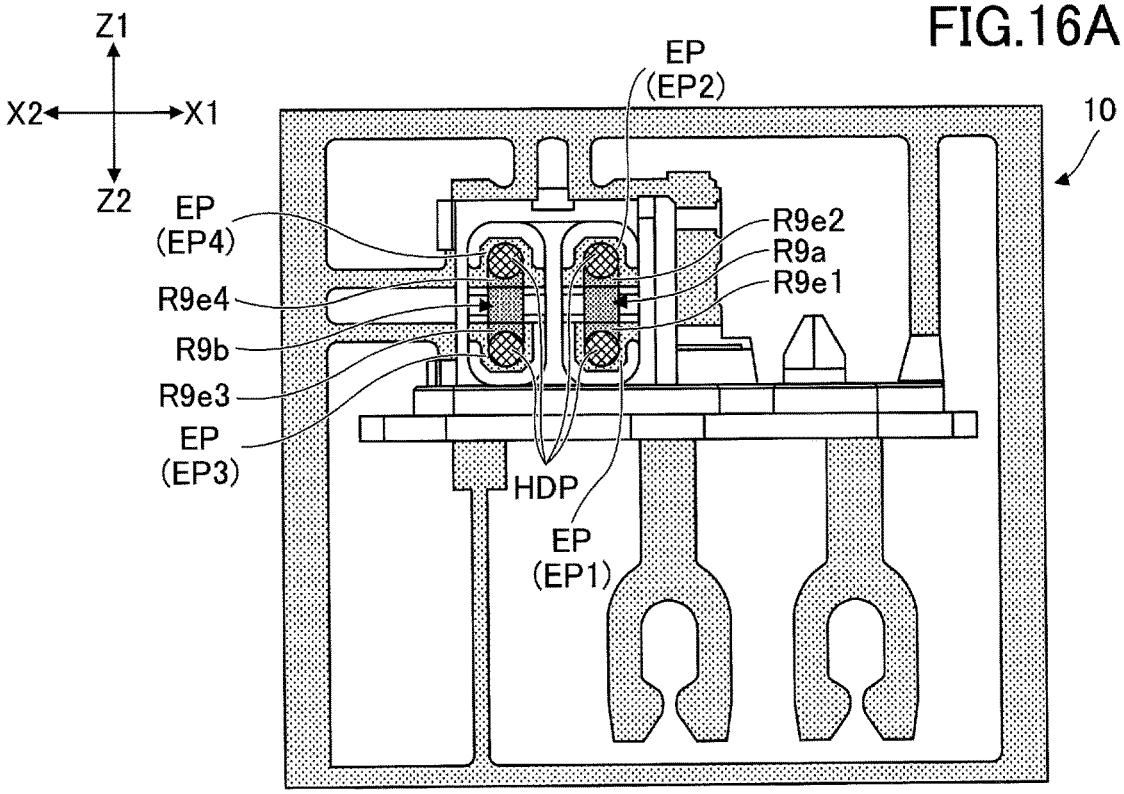
FIGS. 16A and 16B are front views of a metal plate before and after a laser soldering step.
Figure 16B:
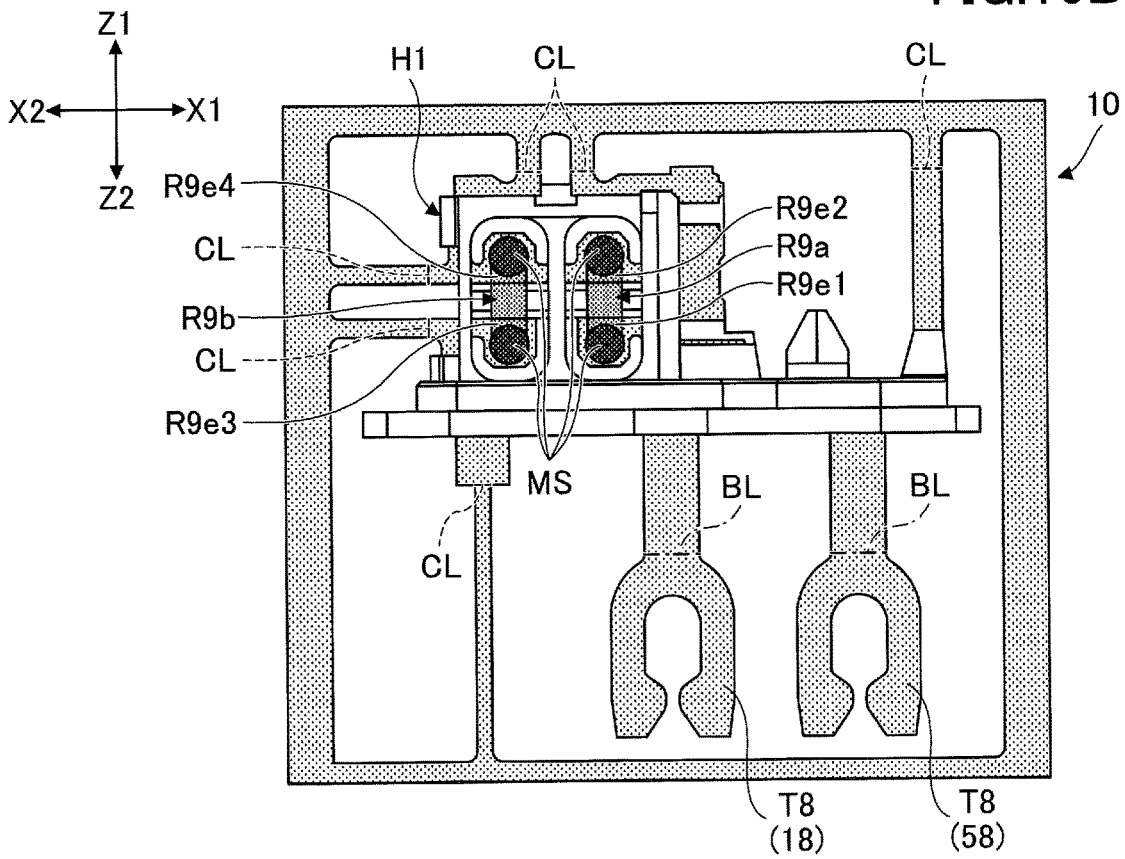

Next, a method of manufacturing the switch 100 is described. FIG. 12 is a flowchart illustrating a process of manufacturing the switch 100. FIGS. 13A and 13B are front views of a frame 10 (or the metal plate M) before and after a frame preparation step p1. Specifically, FIG. 13A is a front view of the frame 10 before the frame preparation step P1 is started, and FIG. 13B is a front view of the frame 10 when the frame preparation step P1 is completed. FIG. 14 is a front view of the frame 10 that is partially embedded in the holding part H1 formed in a molding step P2. FIG. 15 is a front view of the frame 10 to which solder is applied in a solder applying step P31 of a resistor mounting step P3. FIGS. 16A and 16B are front views of the frame 10 on which the resistors R9 are mounted in the resistor mounting step P3. Specifically, FIG. 16A is a front view of the frame 10 on which the resistors R9 are mounted in a resistor mount step P32 of the resistor mounting step P3. FIG. 16B is a front view of the frame 10 when a laser soldering step P33 of the resistor mounting step P3 is completed. In FIGS. 13A through 16B, for clarity, the frame 10 is illustrated as a separate component for manufacturing one switch 100. However, the frame 10 may be a hoop-like frame where multiple frames are continuously connected to each other to form a band.

As illustrated in FIG. 12, the method of manufacturing the switch 100 includes the frame preparation step P1 of preparing the frame 10 in which the first through fourth metal plates M1-M4 (see FIG. 7) are connected to each other via connecting parts 10*r* (see FIG. 13B), the molding step P2 of forming the holding part H1 (see FIG. 14), the resistor mounting step P3 of soldering the resistors R9 (see FIG. 15 and FIGS. 16A and 16B), a cutting step P4 of cutting the connecting parts 10*r* (see FIG. 16B), an assembling step P5 of assembling components, and a bonding step S6 of bonding the holding part H1 to the case K1 after the assembling step P5.

In the frame preparation step P1, as illustrated in FIG. 13A, a conductive metal plate, which is formed of iron, copper, or an alloy including iron or copper as a major component, is prepared. The metal plate is then punched using a metal die. Accordingly, in the frame preparation step P1, as illustrated in FIG. 13B, the frame 10 where the first through fourth metal plates M1-M4 (see FIG. 7) are connected to each other via the connecting parts 10*r* is prepared.

In the molding step P2, as illustrated in FIG. 14, the holding part H1 is formed by insert molding such that the frame 10 is partially embedded in the first synthetic resin material. Specifically, the frame-shaped holding wall 51 is formed such that the surfaces of the first through fourth exposed parts EP1-EP4 are exposed through the inner portion of the holding wall 51. Also, the holding wall 51 is formed such that the surfaces of the first switching fixed contact 15 and the second switching fixed contact 25 are exposed outside of the frame-shaped holding wall 51. Further, the holding wall 51 is formed such that the insulation part 51*r* is disposed between the first switching fixed contact 15 and the second switching fixed contact 25.

The holding wall 51 can be easily formed by insert molding the frame 10 using the first synthetic resin material. When a thermoplastic resin such as a polybutylene terephthalate (PBT) resin containing glass fibers and having a heat distortion temperature between about 120 and about 220 degrees Celsius is used as the first synthetic resin material, the holding part H1 is formed by injection molding.

As illustrated in FIG. 12, the resistor mounting step P3 includes the solder applying step P31 where solder is applied to the exposed parts EP, the resistor mount step P32 where the resistors R9 are placed on the solder applied to the exposed parts EP, and the laser soldering step P33 where the resistors R9 are soldered to the exposed parts EP.

In the solder applying step P31, as illustrated in FIG. 15, a solder paste HDP is applied to a portion of each of the exposed parts EP. In FIG. 15, the solder paste HDP is indicated by rough cross-hatching. Specifically, the solder paste HDP is applied to a portion of the first exposed part EP1, a portion of the second exposed part EP2, a portion of the third exposed part EP3, and a portion of the fourth exposed part EP4. The solder paste HDP is preferably applied using a dispenser.

In the resistor mount step P32, as illustrated in FIG. 16A, the first resistor R9*a* and the second resistor R9*b* are placed on the exposed parts EP held by the holding wall 51. Specifically, the first resistor R9*a* is disposed such that the first electrode R9*e*1 contacts the first exposed part EP1 via the solder paste and the second electrode R9*e*2 contacts the second exposed part EP2 via the solder paste. Similarly, the second resistor R9*b* is disposed such that the third electrode R9*e*3 contacts the third exposed part EP3 via the solder paste and the fourth electrode R9*e*4 contacts the fourth exposed part EP4 via the solder paste. The first resistor R9*a* and the second resistor R9*b* are preferably placed on the exposed parts EP using a surface mounter.

In the laser soldering step P33, a laser beam is emitted toward the solder paste HDP applied to adhere to a portion of each exposed part EP and a portion of an electrode of the corresponding resistor R9 to heat the solder paste HDP. As a result, as illustrated in FIG. 16B, the resistors R9 are soldered and bonded to the exposed parts EP. In FIG. 16B, solder MS solidified after being heated and melted by laser irradiation is indicated by fine cross-hatching.

The above-described manufacturing method does not include a step such as a reflow soldering step where the holding part H1 is exposed to a high temperature. Therefore, the first synthetic resin material having a heat distortion temperature lower than the reflow temperature can be used as the synthetic resin material for forming the holding part H1. This in turn makes it possible to form the switch 100 using a low-price synthetic resin material that does not necessarily withstand the reflow temperature and thereby makes it possible to reduce the manufacturing cost.

In the cutting step P4, the frame 10 is cut at positions indicated by dotted lines CL illustrated in FIG. 16B by, for example, pressing, and components of the switch 100 are detached from the connecting parts 10*r* of the frame 10. Specifically, the holding part H1, in which the metal plate M including the first switching fixed contact 15, the normally-open terminal 18, the second switching fixed contact 25, the common terminal 58, and the common fixed contact G5 is embedded, is separated as a composite component from the rest of the frame 10.

Also in the cutting step P4, the normally-open terminal 18 and the common terminal 58 are bent at positions indicated by dashed-dotted lines BL in FIG. 16B by, for example, a bending process such that the normally-open terminal 18 and the common terminal 58 extend in a desired direction.

Because the frame 10 prepared in the frame preparation step P1 is used until the cutting step P4 is completed, the insert molding at the molding step P2 and the soldering at the resistor mounting step P3 can be easily performed.

In the assembling step P5, as illustrated in FIG. 12, the composite component detached from the frame 10 at the cutting step P4, the movable contact 4 prepared at a movable contact preparation step j1, the moving part 2 prepared at a moving part preparation step j2, the biasing part 3 prepared at a biasing part preparation step j3, the case K1 prepared at a case preparation step j4, and the cover C2 prepared at a cover preparation step j5 are assembled together.

Specifically, one end of the coil spring used as the biasing part 3 is attached to the attaching part 11*t* of the bottom wall 11 of the composite component. Next, the movable contact 4 is placed in the recess 2*r* of the moving part 2, and the connecting base 4*r* of the movable contact 4 is joined to the ceiling of the recess 2*r* by, for example, swaging. Then, the other end of the coil spring (biasing part 3) is positioned to contact the connecting base 4*r*. Here, the connecting base 4*r* is combined with the composite component such that a pair of elastic arms 4*a* (second contacts 4*p*) provided at one end of the connecting base 4*r* sandwich the first switching fixed contact 15, and another pair of elastic arms 4*a* (first contacts 4*p*) provided at the other end of the connecting base 4*r* sandwich the common fixed contact G5.

Then, the case K1 is combined with the holding part H1 to cover the upper side (Z1 side) of the holding part H1. At this step, the moving part 2 is combined with the case K1 such that the operation shaft 2*j* passes through the through hole K1*h* of the case K1 and protrudes upward from the case K1.

In the case preparation step j4, the case K1 is produced using the first synthetic resin material that is also used to produce the holding part H1. This is because neither the holding part H1 nor the case K1 is exposed to a high temperature such as a reflow temperature. Thus, in the switch 100, the case K1 is formed of a thermoplastic synthetic resin material having a heat distortion temperature lower than the reflow temperature. Therefore, compared with a case where the case K1 is formed of a synthetic resin material having a heat distortion temperature higher than the reflow temperature, the present embodiment makes it possible to reduce the manufacturing cost of the switch 100.

Then, in the assembling step P5, the cover C2 is combined with the operation shaft 2*j* protruding upward from the case K1. The cover C2 is disposed on the upper surface of the case K1 to cover the through hole K1*h* of the case K1. At this step, the flange C2*v* of the cover C2 is fitted into the groove K1*m* of the case K1, and the joint portion between the operation shaft 2*j* and the operation part 2*t* is fitted into the through hole C2*h*. To firmly fix the flange C2*v* to the case K1, the ring-shaped resin wall provided around the groove K1*m* of the case K1 may be deformed inward with a swage, or an adhesive may be applied to a position between the flange C2*v* and the resin wall.

Then, in the bonding step P6, the bottom wall 11 of the holding part H1 and the case K1 are bonded together. This step makes it possible to easily join the holding part H1 (the bottom wall 11) and the case K1 together, and also makes it possible to increase the adhesion and the bonding strength between the holding part H1 and the case K1. When the holding part H1 and the case K1 are formed of the same material (the first synthetic resin material) as in the present embodiment, the adhesion and the bonding strength between the holding part H1 and the case K1 are further increased. Also, improving the adhesion and the bonding strength between the holding part H1 and the case K1 can improve the airtightness of the housing 1.

The above-described method of manufacturing the switch 100 has the following effects. In the method of manufacturing the switch 100, the reflow soldering is not used. Therefore, in the molding step p2, the holding part H1 is formed with the first synthetic resin material having a heat distortion temperature lower than the reflow temperature. That is, it is not necessary to use expensive synthetic resin materials having a heat resistance property. In other words, the switch 100 can be manufactured using a relatively inexpensive synthetic resin material.

Also, in the method of manufacturing the switch 100, because the holding part H1 and the case K1 are formed of the same material, laser welding can be used to bond the holding part H1 (the bottom wall 11) to the case K1. Therefore, the holding part H1 and the case K1 can be easily joined together. Further, the airtightness of the housing 1 can be improved by increasing the adhesion and the bonding strength between the holding part H1 and the case K1 with a simple configuration. This in turn makes it possible to further reduce the manufacturing cost of the switch 100.

Further, in the method of manufacturing the switch 100, because laser soldering is used in the laser soldering step P33 of the resistor mounting step P3, the resistors R9 can be easily and reliably soldered to the exposed parts EP of the metal plate M.

In the molding step P2, the bottom wall 11 is formed such that the first synthetic resin material surrounds the entire perimeter of the base of the terminal T8, and the bottom wall 11 closely contacts the terminal T8. This configuration makes it possible to prevent, for example, water from entering the switch 100 through a gap between the terminal T8 and the bottom wall 11.

In the method of manufacturing the switch 100, the frame 10 prepared at the frame preparation step P1 is used from the molding step P2 to the cutting step P4. This makes it easier to perform the insert molding at the molding step P2, the soldering at the resistor mounting step P3, and the detaching of the composite component at the cutting step P4. This in turn improves the manufacturing efficiency of the switch 100.

As described above, the switch 100 of the present embodiment includes the switching mechanism MC that is housed in the housing 1 and configured to switch the state of connection between the normally-open terminal 18 and the common terminal 58 (at least two terminals) exposed out of the housing 1 by using the common fixed contact G5 (common contact) and the first switching fixed contact 15 and the second switching fixed contact 25 (two switching contacts), and the resistors R9 that are disposed in the housing 1 and used as electronic components for electrically connecting the normally-open terminal 18 and the common terminal 58.

As exemplified in FIG. 7, the switching mechanism MC includes the first metal plate M1 that is connected to the common fixed contact G5, which is an example of a first contact that is one of the common contact and the two switching contacts, and includes the first exposed part EP1 to which the first electrode R9*e*1 of the first resistor R9*a* is soldered by laser irradiation; and the second metal plate M2 that is connected to the second switching fixed contact 25, which is an example of a second contact that is another one of the common contact and the two switching contacts, and includes the second exposed part EP2 to which the second electrode R9*e*2 of the first resistor R9*a* is soldered by laser irradiation.

The first exposed part EP1 includes the first electrode mounting part EA1 on which the first electrode R9*e*1 is placed, the first soldering part SD1 on which solder is placed, and the first peripheral part CF1 disposed along the edge of the first soldering part SD1. The second exposed part EP2 includes the second electrode mounting part EA2 on which the second electrode R9*e*2 is placed, the second soldering part SD2 on which solder is placed, and the second peripheral part CF2 disposed along the edge of the second soldering part SD2. Each of the first peripheral part CF1 and the second peripheral part CF2 has a U-shape.

From a different viewpoint, as illustrated in FIG. 8, the first exposed part EP1 includes the first electrode mounting part EA1 on which the first electrode R9*e*1 is placed, and the second exposed part EP2 includes the second electrode mounting part EA2 on which the second electrode R9*e*2 is placed. The first exposed part EP1 further includes the first protruding part PR1 protruding from the first electrode mounting part EA1 in a direction away from the second electrode mounting part EA2, and the second exposed part EP2 further includes the second protruding part PR2 protruding from the second electrode mounting part EA2 in a direction away from the first electrode mounting part EA1. The first connecting part CP1, which connects the first exposed part EP1 of the first metal plate M1 to other parts of the first metal plate M1, is positioned closer to the second exposed part EP2 than the first protruding part PR1; and the second connecting parts CP2, which connect the second exposed part EP2 of the second metal plate M2 to other parts of the second metal plate M2, are positioned closer to the first exposed part EP1 than the second protruding part PR2.

With the above configuration and arrangement, each of the exposed parts EP can be appropriately heated during laser soldering. That is, with the above configuration, heat is less likely to escape from the exposed part EP to other parts during laser soldering.

Thus, the above configuration of the switch 100 makes it possible to properly bond the first resistor R9*a* between the first metal plate M1 and the second metal plate M2 by laser soldering. Compared with a case where the first resistor R9*a* is bonded between the first metal plate M1 and the second metal plate M2 by a method such as reflow soldering in which the housing 1 is exposed to a temperature higher than the temperature in the laser soldering, the present embodiment can reduce the manufacturing cost of the switch 100. This is because the housing 1 can be molded using a relatively inexpensive synthetic resin material with a low heat distortion temperature.

Similarly to the third peripheral part CF3 illustrated in FIG. 10A, the first peripheral part CF1 preferably includes curved parts RP. This configuration of the first peripheral part CF1 of the first exposed part EP1 makes it possible to suppress heat supplied by laser radiation for laser soldering from diffusing from the soldering part SD. Accordingly, the soldering part SD can be quickly heated to a temperature suitable for soldering and can be maintained at the temperature suitable for soldering for an appropriate time period. This in turn makes it possible to reliably bond the first resistor R9*a* to the first metal plate M1 and the second metal plate M2 by laser soldering. However, the first peripheral part CF1 may instead be configured to include corners CN similarly to those of the third peripheral part CF3*x* illustrated in FIG. 10B.

As illustrated in FIG. 7, the first exposed part EP1 and the second exposed part EP2 are preferably arranged symmetrically with respect to the first resistor R9*a*. For example, this arrangement suppresses or prevents the occurrence of the Manhattan effect and damage on an electronic component or the holding part H1 due to the reflection of a laser beam from the surface of the exposed part EP. This is because when laser soldering is performed as illustrated in FIG. 9, the above arrangement makes it possible to melt the solder contained in the solder paste HDP1 and the solder contained in the solder paste HDP2 at the same timing and in the same manner.

The first exposed part EP1 of the first metal plate M1 may be a component different from other parts (another part, or a remaining part) of the first metal plate M1, and the second exposed part EP2 of the second metal plate M2 may be a component different from other parts (another part, or a remaining part) of the second metal plate M2. For example, the first exposed part EP1 and the other parts (another part, or a remaining part) of the first metal plate M1 may be formed of different materials, and the second exposed part EP2 and the other parts (another part, or a remaining part) of the second metal plate M2 may be formed of different materials. Specifically, the first exposed part EP1 and the other parts of the first metal plate M1 may be formed of different types of metals. Alternatively, the other parts may include portions formed of materials other than metals. This configuration makes it possible to make heat less likely to escape from the first exposed part EP1 to the other parts during laser soldering. This is because the transfer of heat from the first exposed part EP1 to the other parts is suppressed.

Alternatively, the first exposed part EP1 of the first metal plate M1 and the other parts (another part, or a remaining part) of the first metal plate M1 may be formed monolithically (as a single component) with the same material, and the second exposed part EP2 of the second metal plate M2 and the other parts (another part, or a remaining part) of the second metal plate M2 may be formed monolithically (as a single component) with the same material. For example, this configuration makes it possible to easily form the first metal plate M1 including the first exposed part EP1, the common fixed contact G5, and the common terminal 58 by a method such as punching.

The housing 1 is preferably configured to include the case K1 and the holding part H1 for holding the first metal plate M1 and the second metal plate M2. The holding part H1 is preferably formed of a material having a heat distortion temperature lower than the reflow temperature. Compared with the case where the first resistor R9*a* is bonded to the first metal plate M1 and the second metal plate M2 by reflow soldering, this configuration can reduce the manufacturing cost of the switch 100. This is because the housing 1 can be molded using a relatively inexpensive synthetic resin material with a heat distortion temperature lower than the reflow temperature.

A method of manufacturing the switch 100 according to the present embodiment includes a step of soldering the first electrode R9*e*1 of the first resistor R9*a* (which is an example of an electronic component) by laser irradiation to the first metal plate M1 connected to the common fixed contact G5 (which is an example of a first contact that is one of a common contact and two switching contacts); and a step of soldering the second electrode R9*e*2 of the first resistor R9*a* by laser irradiation to the second metal plate M2 connected to the second switching fixed contact 25 (which is an example of a second contact that is another one of the common contact and the two switching contacts). Compared with a case where the first resistor R9*a* is bonded between the first metal plate M1 and the second metal plate M2 by a method in which the housing 1 is exposed to a temperature higher than the temperature in the laser soldering, this method can reduce the manufacturing cost of the switch 100. This is because the housing 1 can be molded using a relatively inexpensive synthetic resin material with a low heat distortion temperature.

A switch and a method for manufacturing the switch according to the embodiment of the present invention are described above. However, the present invention is not limited to the specifically disclosed embodiment, and variations and modifications may be made without departing from the scope of the present invention. Features described in the above embodiment may be combined in any appropriate manner unless they are technically inconsistent with each other.

For example, although laser welding is used to bond the holding part H1 to the case K1 in the bonding step P6 described above, an adhesive may instead be used for this purpose.

Also, in the above embodiment, the switch 100 includes the switching mechanism MC that switches the state of connection between the normally-open terminal 18 and the common terminal 58. However, the switching mechanism MC may be configured to switch the state of connection among a normally-open terminal, a normally-closed terminal, and a common terminal.

The present invention may be applied not only to the switch 100 but also to any other device including a metal plate partially embedded in a synthetic resin component housed in a housing and an electronic component bonded by laser soldering to the metal plate.

What is claimed is:

1. A switch, comprising:

a housing;

a switching mechanism that is housed in the housing and configured to switch a state of connection between at least two terminals exposed out of the housing by using a common contact and two switching contacts; and an electronic component that is disposed in the housing and electrically connects the at least two terminals to each other, wherein the switching mechanism includes a first metal plate that is connected to a first contact, which is one of the common contact and the two switching contacts, and includes a first exposed part to which a first electrode of the electronic component is soldered by laser irradiation, and a second metal plate that is connected to a second contact, which is another one of the common contact and the two switching contacts, and includes a second exposed part to which a second electrode of the electronic component is soldered by laser irradiation;

the first exposed part includes a first electrode mounting part on which the first electrode is placed, a first soldering part on which solder is placed, and a first peripheral part disposed along an edge of the first soldering part;

the second exposed part includes a second electrode mounting part on which the second electrode is placed, a second soldering part on which solder is placed, and a second peripheral part disposed along an edge of the second soldering part; and each of the first peripheral part and the second peripheral part has a U-shape.

2. The switch as claimed in claim 1, wherein the first peripheral part includes a curved part.

3. The switch as claimed in claim 1, wherein the first peripheral part includes a corner.

4. The switch as claimed in claim 1, wherein the first exposed part and the second exposed part are arranged symmetrically with respect to the electronic component.

5. The switch as claimed in claim 1, wherein the first exposed part of the first metal plate and a remaining part of the first metal plate are formed of different materials.

6. The switch as claimed in claim 1, wherein the second exposed part of the second metal plate and a remaining part of the second metal plate are formed of different materials.

7. The switch as claimed in claim 1, wherein the first exposed part of the first metal plate and a remaining part of the first metal plate are formed monolithically with a same material.

8. The switch as claimed in claim 1, wherein the second exposed part of the second metal plate and a remaining part of the second metal plate are formed monolithically with a same material.

9. The switch as claimed in claim 1, wherein the electronic component is a resistor.

10. The switch as claimed, in claim 1, wherein the housing includes a case and a holding part that holds the first metal plate and the second metal plate; and the holding part is formed of a material with a heat distortion temperature lower than a reflow temperature.

11. A method of manufacturing a switch that includes a housing, a switching mechanism that is housed in the housing and configured to switch a state of connection between at least two terminals exposed out of the housing by using a common contact and two switching contacts, and an electronic component that is disposed in the housing, and electrically connects the at least two terminals to each other, the switching mechanism including a first metal plate that is connected to a first contact, which is one of the common contact and the two switching contacts, and includes a first exposed part, and a second metal plate that is connected to a second contact, which is another one of the common contact and the two switching contacts, and includes a second exposed part;

the first exposed part including a first electrode mounting part, a first soldering part, and a first peripheral part disposed along an edge of the first soldering part;

the second exposed part including a second electrode mounting part, a second soldering part, and a second peripheral part disposed along an edge of the second soldering part; and each of the first peripheral part and the second peripheral part having a U-shape, the method comprising:

applying solder to the first soldering part, placing a first electrode of the electronic component on the first electrode mounting part, and soldering the first electrode of the electronic component by laser irradiation to the first exposed part; and applying solder to the second soldering part, placing a second electrode of the electronic component on the second electrode mounting part, and soldering the second electrode of the electronic component by laser irradiation to the second exposed part.

12. A switch, comprising:

a housing;

a switching mechanism that is housed, in the housing and configured to switch a state of connection between at least two terminals exposed out of the housing by using a common contact and two switching contacts; and an electronic component that is disposed in the housing and electrically connects the at least two terminals to each other, wherein the switching mechanism includes a first metal plate that is connected to a first contact, which is one of the common contact and the two switching contacts, and includes a first exposed part to which a first electrode of the electronic component is soldered by laser irradiation, and a second metal plate that is connected to a second contact, which is another one of the common contact and the two switching contacts, and includes a second exposed part to which a second electrode of the electronic component is soldered by laser, irradiation;

the first exposed part includes a first electrode mounting part on which the first electrode is placed;

the second exposed part includes a second electrode mounting part on which the second electrode is placed;

the first exposed part further includes a first protruding part that protrudes from the first electrode mounting part in a direction away from the second electrode mounting part;

the second exposed part further includes a second protruding part that protrudes, from the second electrode mounting part in a direction away from the first electrode mounting part;

the first metal plate further includes a first connecting part that connects the first exposed part to a remaining part of the first metal plate, the first connecting part being disposed closer to the second exposed part than the first protruding part; and the second metal plate further includes a second connecting part that connects the second exposed part to a remaining part of the second metal plate, the second connecting part being disposed closer to the first exposed part than the second protruding part.

* * * * *